US010081473B2

(12) United States Patent
Burri et al.

(10) Patent No.: US 10,081,473 B2
(45) Date of Patent: Sep. 25, 2018

(54) PACKAGING CONTAINER WITH PULL TAB

(71) Applicant: AMPAC HOLDINGS, LLC, Cincinnati, OH (US)

(72) Inventors: David Burri, Obergerlafingen (CH); Andrea Lazzara, Ersigen (CH); Martin Kropf, Munchenbuchsee (CH); Salvatore Pellingra, Newport, KY (US); Andreas Hofer, Urtenen-Schonbuhl (CH)

(73) Assignee: AMPAC HOLDINGS, LLC, Cincinnati, OH (US)

( * ) Notice: Subject to any disclaimer, the term of this patent is extended or adjusted under 35 U.S.C. 154(b) by 534 days.

(21) Appl. No.: 13/835,716

(22) Filed: Mar. 15, 2013

(65) Prior Publication Data

US 2013/0279832 A1 Oct. 24, 2013

Related U.S. Application Data

(63) Continuation-in-part of application No. 13/442,566, filed on Apr. 9, 2012.

(30) Foreign Application Priority Data

Apr. 8, 2011 (EP) ..... 11161607
Apr. 9, 2012 (WO) ..... PCT/US2012/032775

(51) Int. Cl.
*B65D 75/58* (2006.01)
*B65D 75/62* (2006.01)
(Continued)

(52) U.S. Cl.
CPC ..... *B65D 75/5855* (2013.01); *B65D 75/008* (2013.01); *B65D 75/5811* (2013.01);
(Continued)

(58) Field of Classification Search
CPC ..... B65D 75/58; B65D 75/5827; B65D 75/5833; B65D 75/5838; B65D 75/5844; B65D 75/5894
(Continued)

(56) References Cited

U.S. PATENT DOCUMENTS 2,288,914 A 7/1942 Monroe
3,002,674 A 10/1961 Wright
(Continued)

FOREIGN PATENT DOCUMENTS

CA 1116130 1/1982
CH 427637 12/1966
CH 636314 5/1983

*Primary Examiner* — Jes F Pascua
*Assistant Examiner* — Nina Attel

(57) ABSTRACT

A packaging container with a pull tab is provided. The packaging container includes a pouch with at least one opening or at least one perforated openable area in a pouch wall, and one or more pull tab labels adhesively connected to at least one outside wall of the pouch and covering the at least one opening or one perforated openable area. The one or more pull tab labels include a substrate with at least one notch in an edge of the pull tab label and a pressure sensitive adhesive on at least a portion of one surface of the substrate. The peel strength between the pull tab label and the outside wall of the pouch is lower in the area of the pull tab label proximate the notch then in the area of the pull tab label proximate the opening or the perforated openable area in the pouch.

37 Claims, 14 Drawing Sheets

(51) Int. Cl.

| | |
|---|---|
| ***B65D 75/00*** | (2006.01) |
| *B31B 160/10* | (2017.01) |
| *B31B 70/14* | (2017.01) |
| *B31B 155/00* | (2017.01) |
| *B31B 70/81* | (2017.01) |
| *B31B 70/84* | (2017.01) |
| *B31B 170/20* | (2017.01) |

(52) U.S. Cl.
CPC ..... *B65D 75/5827* (2013.01); *B65D 75/5833* (2013.01); *B65D 75/5838* (2013.01); *B31B 70/14* (2017.08); *B31B 70/813* (2017.08); *B31B 70/844* (2017.08); *B31B 2155/00* (2017.08); *B31B 2160/10* (2017.08); *B31B 2170/20* (2017.08)

(58) Field of Classification Search
USPC .... 383/200, 201, 203–205, 207–211, 84, 85, 383/86; 220/359.1–359.4
See application file for complete search history.

(56) References Cited

U.S. PATENT DOCUMENTS

| | | | | |
|---|---|---|---|---|
| 3,166,226 | A | 1/1965 | Mobley | |
| 3,453,661 | A * | 7/1969 | Repko | 401/132 |
| 3,606,962 | A | 9/1971 | Scholle | |
| 3,918,608 | A | 11/1975 | Faller | |
| 4,194,680 | A * | 3/1980 | Scott et al. | 229/123.2 |
| 4,610,357 | A | 9/1986 | Nakamura | |
| 4,889,234 | A * | 12/1989 | Sorensen et al. | 206/459.5 |
| 5,141,795 | A * | 8/1992 | Kai et al. | 428/138 |
| 5,833,368 | A * | 11/1998 | Kaufman | 383/205 |
| 5,938,013 | A | 8/1999 | Palumbo et al. | |
| 6,698,928 | B2 | 3/2004 | Miller | |
| 6,959,832 | B1 * | 11/2005 | Sawada et al. | 220/359.2 |
| 7,055,720 | B1 * | 6/2006 | Pritchard | 222/107 |
| 7,175,581 | B2 | 2/2007 | Murray | |
| 2002/0119292 | A1 * | 8/2002 | Venkatasanthanam et al. | 428/174 |
| 2004/0178254 | A1 * | 9/2004 | Ronan et al. | 229/153 |
| 2005/0167026 | A1 * | 8/2005 | Dronzek et al. | 156/69 |
| 2005/0276525 | A1 | 12/2005 | Hebert et al. | |
| 2006/0200107 | A1 * | 9/2006 | Motsch et al. | 604/385.02 |
| 2008/0063324 | A1 | 3/2008 | Bernard et al. | |
| 2011/0147383 | A1 | 6/2011 | Soudais et al. | |
| 2012/0048857 | A1 | 3/2012 | Bando | |
| 2012/0328818 | A1 * | 12/2012 | Dronzek, Jr. | 428/43 |
| 2013/0114918 | A1 * | 5/2013 | Lyzenga et al. | 383/203 |
| 2013/0177802 | A1 * | 7/2013 | Zaikov | 429/176 |

* cited by examiner

PACKAGING CONTAINER WITH PULL TAB

CROSS REFERENCE TO RELATED APPLICATIONS

This is a Continuation-In-Part Application which claims priority to Non-provisional U.S. application Ser. No. 13/442,566 filed on Apr. 9, 2012, herein incorporated by reference in their entirety.

FIELD

The invention involves a packaging container made from a minimum of one layer of shaped container or packaging material, with a pull tab to make an opening. It also relates to a packaging container with a pull tab label to make an opening.

BACKGROUND

Packaging containers with an opening that can be pulled 10 have been around for a long time. Swiss patent 427637, registered in 1964, describes a tetrahedron container made from layered material with an opening that is sealed with a pull tab connected to the outside layer of the container.

Swiss patent 636314 features a drink container made of multiple layers of composite material, in which one of the container walls has a pre-punched hole that goes through to the inner layer. The hole is covered with a closure strip that is connected to the inner layer in the closure area.

By pulling on the closure strip, the inner layer is pulled in the area of the closure and this creates a pocket opening for a straw. Both of the above-described drink containers have the same disadvantage, that many users simply let the pull tab fall after pulling on it. This is, of course, undesirable.

A solution for the problem of the improperly discarded pull tabs that were torn off was found with the object described in European patent registration 600502. In a standing container, a puncture opening is stamped through all the layers of the container wall and on the inner side of the container wall there is a closure film attached to the puncture opening, through which the puncture opening is exposed to the outside. This solution is beset with several disadvantages. It is not always easy to stick a straw through the closure film. In order to minimize this disadvantage, one is forced to taper the straw by sharpening it, which then results in an increased risk of injury to the person. In addition, puncturing through the closure film involves the risk of unwanted puncturing of the container wall on the other side of the puncture opening, especially when the puncture opening is located in the area of the upper edge of the standing container, since the front and back walls are relatively close to each other. Finally, the exposed puncture opening is hygienically questionable; impurities and/or bacteria could collect there, which could get in when the straw is stuck into the inside of the container.

A need exists for an improved pull tab label and an improved pull tab label and pouch combination, wherein the pull tab label is not integrated as part of the pouch.

BRIEF DESCRIPTION OF THE DRAWINGS

Design examples of the invention are described as examples below with reference to the attached drawings. The following are depicted.

DETAILED DESCRIPTION

Figure 2:
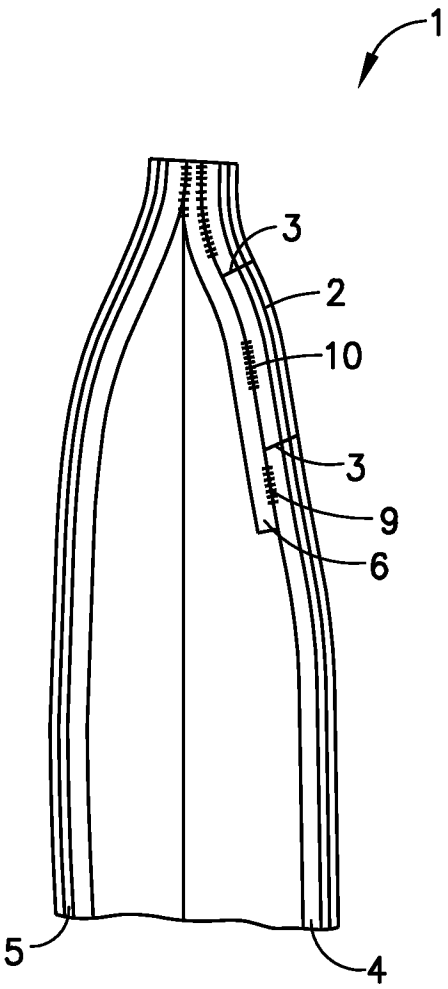
FIG. 2 a vertical cut along line II-II in FIG. 3 and FIG. 10.

Starting from this status of the technology, this invention is based on the goal of proposing a packaging container in which the opening can be built without needing a straw or something similar to punch a hole through it and in which the place where the opening that needs to be made is protected from getting dirty before the opening is made.

Integrated Pull Tab—Pouch Embodiment

In one embodiment of the instant invention, these goals will be achieved with an invention in which the pull tab is created from a cutline in the packaging material, which has a closure film is attached to it—at least in the area of the pull tab in the inner side of the packaging material—and which is connected to the closure film in a connection area, so that when the pull tab is pulled, an opening is created in the connection area.

In this embodiment, since the pull tab is created from a cutline in the packaging material, adding a separate pull tab, for example by sealing or gluing, is not necessary.

Since part of the pull tab is connected to the closure film, the closure film in this area is ripped open by normal pulling on the pull tab, which creates an opening through which the contents of the container can exit, for example, through a straw inserted into the opening. In addition, the place where the opening is created is covered through the action of pulling on the pull tab and protected from getting dirty.

When, according to one design, the connection area is tapered toward the open end of the pull tab, the creation of the container opening is made easier by pulling on the pull tab in the area of the pointed end, which has more stress concentration.

According to another design, the cutline has two open ends and is also shaped in the form of a "U." The pull tab created by this remains attached to the packaging container after the opening is created.

According to another design, the closure film is connected to the packaging material in one of the connection zones around the pull tab and the connection area is lined up with one end of the pull tab, so the closure film hangs together with the connection zone. With this design, first of all, the creation of the opening does not begin until the pull tab has been pulled as far as possible. Then the resistance noticeably increases upon pulling on the pull tab, so that as soon as the opening reaches the connection zone, at which point the end of the opening process is signaled and stopped, further damage to the packaging container through continued pulling on the pull tab is prevented.

According to another design, the cutline does not have a free and borders a closed bottle. With this, the pull tab is completely pulled off the packaging container.

According to an additional design, the closure film is connected with the packaging material in one of the connection zones around the pull tab, and the connection area is matched up with the end of the pull tab. With this, the resistance decreases after the opening is created, with the tension then transferring to the pull, so that it can be completely pulled off, if desired.

According to a further design, the cutline is designed with perforations along at least one part of its length. By this means, the pull tab is connected to the packaging material and does not come off of the packaging material before it is opened.

According to an additional design, the cutline has continuous perforations along at least one part of its length. With this, the opening process is simplified, especially when the perforated part of the cutline is lined up with the free end of the pull tab.

According to another design, the pull tab on the outside of the packaging material is covered with sealing foil or film that extends over the cutline. With this, hygiene is further improved and, other issues are specifically avoided, such as for example, moisture getting under the pull tab while the packaging container is stored.

Pull Tab Label Embodiment and Method of Making

In an alternative embodiment of the instant invention, the pull tab is a separate label and is not integral to the pouch as the embodiment described above. This is referred to as the pull tab label embodiment. In this embodiment, a separate label is formed, which is then applied over a perforated area in the pouch or over a pre-cut hole or opening in the pouch. A portion of the pull tab label has a pressure sensitive adhesive on at least a portion of the surface that contacts the pouch such that it will adhere to the pouch. In one form, the pull tab label may be rectangular in shape with a slit, cut-out or notch in one or more of the edges of the rectangular shape. A notch with regard to the pull tab label is defined as a cut-out, a cut, a slit or other indentation in an edge of the pull tab. In one advantageous form, the notch is "v" shaped. The notch could be an alternative shape for an indentation in the edge of the pull tab. For example, the notch may be "w" or "A" or "E" or "F" shaped or any another shape that provides an apex for tear initiation.

For example when the notch is "v" shaped, the "v" notch is used for initiating the tearing of the pull tab label at its apex and the peeling of the pull tab label from the pouch when the user is ready to make an opening or expose an opening in the pouch for insertion of a straw or other device. The cut-out or tear notch in an edge of the pull tab label may be formed by laser scoring or mechanically scoring the edge. There may also be more than one cut-out or notch in the pull tab label for initiating the peeling and removing of the layer at multiple locations.

Figure 11:
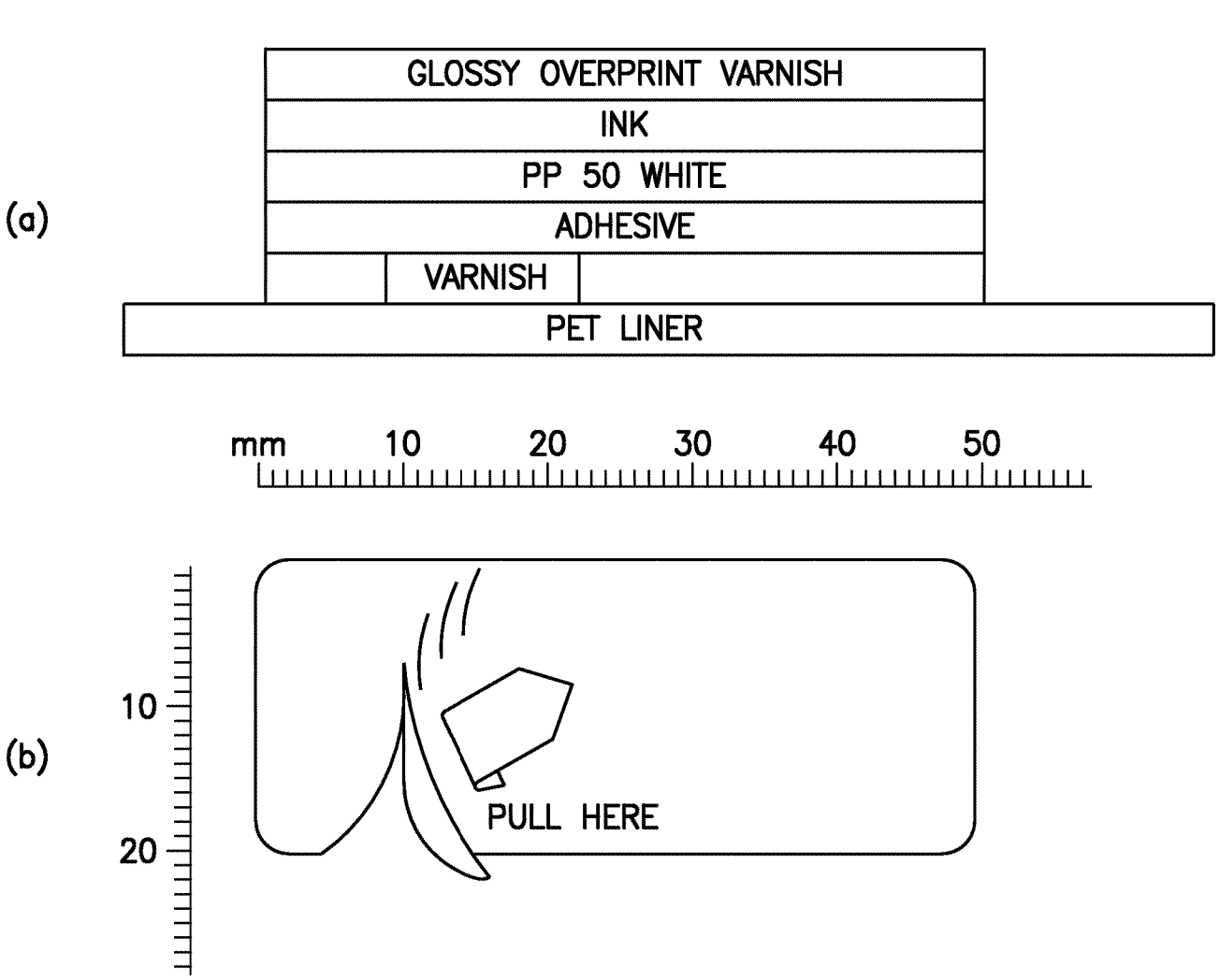

The pull tab label may optionally include a series of cuts or slits in the label (for example, see FIG. 11 (*b*) depicting 3 curved slits or cuts above and proximate to the "v" shaped notch) which assist with the directional tearing of the label toward the area of the pouch with the openable area or opening as opposed to the area of the pouch that does not have an opening or openable area. The slits or cuts in the pull tab label may also be straight as opposed to curved and may number from 1 to 6, or 2 to 5, or 3 to 4. The slits or cuts in the pull tab label may be equidistant from one another or they may be non-equidistant from one another. The slits or cuts are advantageously proximate the notch so that when a tear is initiated in the label at the notch (for example at an apex in the notch), the slits or cuts may then direct the tearing to the side of the pull tab label covering the openable area or opening in the pouch. The slits or cuts advantageously pass through the entire thickness of the pull tab label, but may also pass through a majority of the thickness of the label. The tear directing slits or cuts may range in length from 1 to 20 mm, or 3 to 15 mm, or 5 to 10 mm depending upon the size of the pull tab label.

In one form of the pull tab label and pouch combination embodiment, a perforated area in the pouch is formed with a punch that has raised teeth or other suitable device, which is subsequently covered by the pull tab label. The perforated area in the pouch may become an opening after being removed by the pull tab label. In this form, the area of the pouch inside the perforation is not removed from the pouch during pouch formation, but remains in intact on the pouch after it is formed. This area shall be referred to herein as the chad or the perforated openable area. One or more perforated areas may be formed in one or two of the panels or walls (front and back) of the pouch. The perforated openable area may be in any suitable shape and dimensions for adequately allowing for the removal of the pouch contents. Non-limiting exemplary shapes of the perforated openable area includes circular, oval, square, rectangular, and diamond. One preferred shape is circular for creating a hole for the insertion of a straw.

Figure 18:
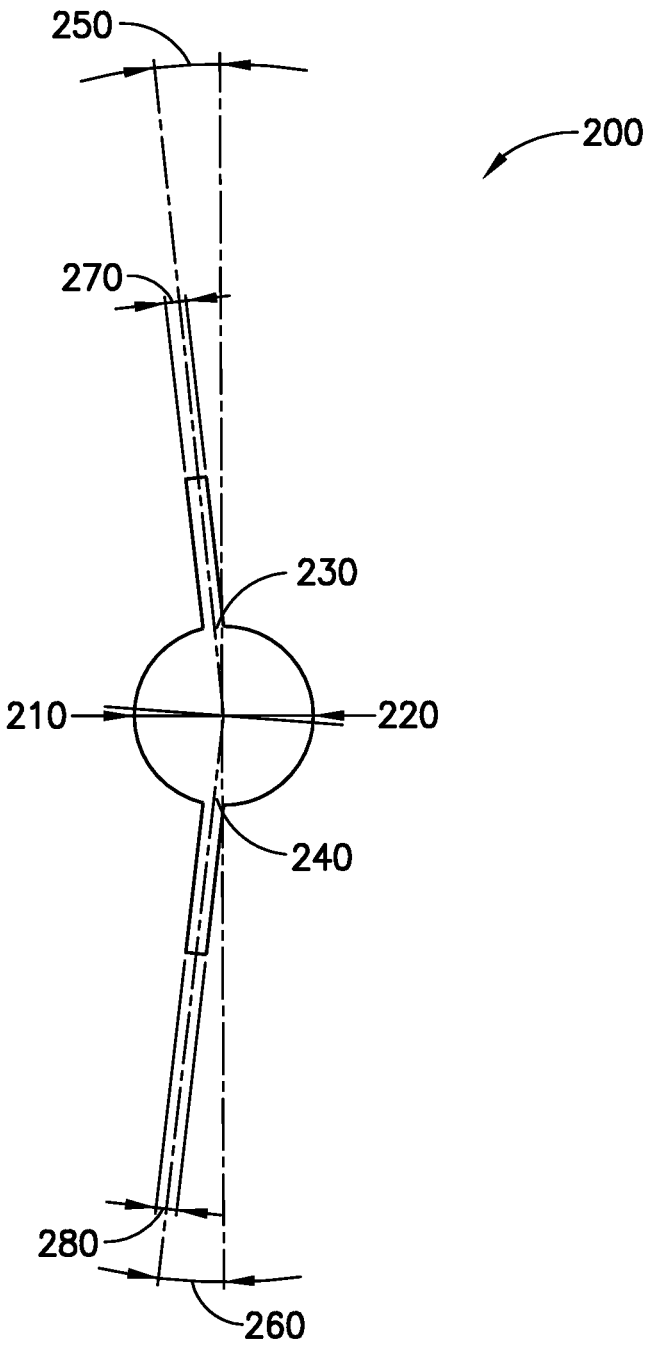
FIG. 18 is a front view of a perforated openable area in the shape of a circle for a pouch.

In one form of the perforated openable area 200 depicted in FIG. 18, the perforated area or chad is circular and includes two semi-circular cuts (shown as two solid half-circle lines 210, 220) with two non-perforated areas 230, 240. In one form, the non-perforated areas 230, 240 are approximately 180 degrees offset from one another (on each side of a vertical line). In another form, as shown in FIG. 18, the two non-perforated areas are slightly offset from 180 degrees or from vertical with the offset range being from 1 to 15 degrees, or 3 to 12 degrees, or 5 to 9 degrees. The offset angle from 180 degrees or vertical is indicated in FIG. 18 as 250 and 260. The width of the non-perforated area is indicated in FIG. 18 as 270 and 280. In one advantageous form, the offset from 180 degrees or vertical is 7 degrees. The non-perforated area 270, 280 may range in width from 0.1 to 1.0 mm, or 0.3 to 0.8 mm, or 0.5 to 0.7 mm. In one advantageous form, the width of the non-perforated area is 0.6 mm. For example, when the diameter of the openable perforated area or chad is 8 mm and the offset of the two non-perforated areas is 7 degrees from vertical, the chad may be effectively removed from the perforated area when the pull tab is peeled away from the wall of the pouch. The chad will adhere to the pressure sensitive adhesive on the pull tab label as opposed to falling within the pouch and contaminating its contents.

The pull tab label covers the perforated openable area in one of the panels or walls of the pouch. When the pull tab label is peeled from the panel or wall of the pouch, the pressure sensitive adhesive removes the area of the pouch inside the perforated openable area (the "chad") and creates an opening in the pouch. The opening in the pouch then allows for the contents to be removed or dispensed. In effect, the pull tab label when peeled from the pouch removes the chad of the perforated openable area and thus creates an opening. This will be referred to as the pull tab label—perforated pouch form of the invention.

The pull tab label—perforated pouch form of the invention is distinguishable relative to the prior art in that the pouch is fully in tact with no opening in its panel or wall when the pull tab label is applied. The pouch is merely perforated in one or more areas of the panel or wall, which allows the pressure sensitive adhesive and pull tab combination to create the opening by removing the chad during the peeling of the pull tab from the pouch. This permits the barrier properties of the pouch to be maintained because an opening in the panel or wall is not formed until the pull tab label is peeled away. The chad once it is removed from the pouch panel remains adhered to the pressure sensitive adhesive of the pull tab. The pull tab may also be reapplied to the pouch to cover the opening that was formed. This opening and reclosing process may be repeated several times. Another benefit of the pull tab label—perforated pouch form of the invention is that the strength and rigidity of the pouch is not substantially compromised because a perforation area is created in the panel of the pouch as opposed to an opening via a puncture of the panel. In this form of the invention, the peel strength between the pressure sensitive adhesive of the pull tab label and the panel of the pouch is greater than the force needed to remove the inside perforation area (chad) of the pouch such that the chad will be removed upon peeling the pull tab label from the pouch.

In another form, an opening in the pouch is formed in the pouch prior to the application of a pull tab label. Hence, an area of the pouch is punctured as opposed to perforated to create the opening using a punch type mechanism or other suitable device. The punched area to create the opening may be in any suitable shape for allowing the removal of the pouch contents. Non-limiting exemplary shapes of the punched opening area include circular, oval, square, rectangular, and diamond. One preferred shape is circular for creating a hole for the insertion of a straw.

The pull tab label covers the punched open area in one or more of the panels or walls of the pouch. When the pull tab label is peeled from the panel of the pouch, the opening in the pouch is exposed to the outside of the pouch. The opening in the pouch then allows for the contents to be removed. In effect, the pull tab label when peeled from the pouch exposes the opening. This will be referred to as the pull tab label—punched pouch form of the invention.

Both the pull tab label—punched pouch form of the invention and the pull tab label—perforated pouch form of the invention permit a relatively large opening to be created in the panel or wall of the pouch. For circular openings, the diameter may be greater than or equal to 4 mm, or greater than or equal to 6 mm, or greater than or equal to 8 mm, or greater than or equal to 10 mm, or greater than or equal to 12 mm, or greater than or equal to 14 mm, or greater than or equal to 16 mm, or greater than or equal to 18 mm, or greater than or equal to 20 mm. By having a large hole exposed in the pouch upon the peeling away of the pull tab label, a large diameter straw can be accommodated, which permits the removal of more viscous liquids (such a smoothies, milk shakes, frozen beverages, etc.).

The pouch of the pull tab label may be made of any materials used for making stand up pouches. Non-limiting exemplary materials include polyester, polyamide, aluminum foil, metallized oriented polypropylene, metallized oriented polyester, metallized oriented polyamide, polypropylene, polyethylene, ethylene vinyl alcohol, biopolymers, and copolymers and terpolymers of ethylene, propylene and butene-1.

In one form, the pouch may be made from a three layer lamination of polyester film, aluminum foil and heat sealable polyethylene film. The heat sealable polyethylene film may alternatively be copolymers or terpolymers of ethylene, propylene and butene-1. The polyester film may be on the outside of the pouch to provide for aesthetic properties and the polyethylene film on the inside of the pouch to provide for sealability. The three layers may be joined together by either extrusion lamination, adhesive lamination or a combination thereof. The polyester film may range in thickness from 8 to 25 microns, or 10 to 20 microns, or 12 to microns. A polyester film thickness of 12 microns is particularly advantageous. The aluminum foil may range in thickness from 4 to 20 microns, or 6 to 16 microns, or 8 to 12 microns. An aluminum foil thickness of 8 microns is particularly advantageous. The polyethylene film may range in thickness from 25 to 100 microns, or 40 to 90 microns, or 60 to 80 microns. A polyethylene film thickness of 70 microns is particularly advantageous. The three layers may be joined together via adhesive lamination using an epoxy, urethane or acrylic based adhesive. The adhesive may be a solvent based or a solvent free adhesive. The thickness of the adhesive may range from 1 to 10 microns, or 1.2 to 8 microns, or 1.4 to 5 microns. In one particularly advantageous form, the adhesive is H.P Fuller Flextra® SBA 5201+XA3366 solvent based adhesive at a thickness of about 3 microns. In another particularly advantageous form, the adhesive is H.P Fuller Flextra® SFA 8220+XRS 1220 solvent free adhesive at a thickness of about 1.3 microns. The aluminum foil in the three layer construction may be alternatively replaced with a metallized oriented polypropylene, metallized oriented polyamide or a metallized oriented polyester film for providing barrier properties to the laminate.

In another form, the pouch may be made from a two layer lamination of polyester film, and a heat sealable barrier or non-barrier type polyethylene film. Where barrier properties are required, the polyethylene film may include a layer of ethylene vinyl alcohol copolymer or other suitable barrier polymer. The two layers may be joined together by either extrusion lamination, adhesive lamination or a combination thereof. The substrate thicknesses described above for the three layer lamination also apply for the two layer lamination. The outer polyester film of the two and three layer laminates may be reversed printed or surface printed for graphics appeal and product identification.

The pull tab label of the pull tab label embodiment may be a substrate with a pressure sensitive adhesive on one surface of the substrate. A pressure sensitive adhesive is defined as a self-adhesive or self-stick adhesive which forms a bond when pressure is applied to marry the adhesive with the adherend (the outside wall or panel of the pouch). No solvent, water, or heat is needed to activate the adhesive. The pressure sensitive adhesive should be suitable for direct food contact with dry and wet, non-fatty foodstuffs and liquids. The substrate of the pull tab label is coated on one surface with a pressure sensitive adhesive, such as for example an acrylic hot melt adhesive. One preferred type of acrylic hot melt adhesive is Tesa P01, which is a uv-curable acrylic prepolymer. After curing, the pressure sensitive adhesive combines medium to good peel adhesion properties with high shear resistance at elevated temperatures. The coating weight for the pressure sensitive adhesive may range from 5 to 30 g/m$^2$, or 10 to 25 g/m$^2$, or 14 to 18 g/m$^2$. The peeling adhesion or strength (measured from steel after 20 minutes at approx. 23° C. and 50% air humidity) of the pressure sensitive adhesive may range from 2 to 12 N/20 mm, or 4 to 10 N/20 mm, or 5 to 8 N/20 mm. Other exemplary pressure sensitive adhesives include urethanes, butyl rubber, ethylene-vinyl acetate, natural rubber, nitriles, silicone rubbers, styrene block copolymers, styrene-butadiene-styrene, styrene-ethylene/butylene-styrene, styrene-ethylene/propylene and styrene-isoprene-styrene and vinyl ether.

The substrate of the pull tab label may be paper or aluminum foil, but is preferably polymeric in nature. Non-limiting exemplary polymeric substrates are polypropylene, biopolymers, polyethylene, polybutene, polyester, polyamide, polyvinylchloride, and copolymers and terpolymers of polypropylene, polyethylene, and polybutene. The substrate may also be vacuum metallized with aluminum on at least one surface to enhance aesthetics and barrier properties. The thickness of the substrate for the pull tab label may range from 10 to 100 microns, or 20 to 80 microns, or 40 to 60 microns. One preferred substrate and thickness is 50 micron polypropylene.

One surface of the substrate of the pull tab label may be printed (surface or reverse) via either flexographic or rotogravure printing techniques. When surface printed, an overprint varnish may be coated over the surface printing to protect the ink. When reverse printed, an overprint varnish is not needed.

A varnish may be applied to the pressure sensitive adhesive in the area of the notch in the pull tab label. This keeps the pull tab label from adhering to the pouch in this area, which allows for an area where the pull tab will be lifted from the pouch and the peeling of the pull tab from the pouch to be initiated. Non-limiting exemplary varnishes include acrylics and urethanes. The coating weight of the varnish may range from 5 to 30 g/m$^2$, or 10 to 25 g/m$^2$, or 14 to g/m$^2$. The peeling adhesion or strength (measured from steel after 20 minutes at approx. 23° C. and 50% air humidity) of the varnish may range from 1 to 5 N/20 mm, or 2 to 4 N/20 mm. The peeling strength of the varnish is lower than the peeling strength of the pressure sensitive adhesive and may range from 2 to 10 N/20 mm lower, or 3 to 9 N/20 mm lower, or 4 to 8 N/20 mm lower, or 5 to 7 N/20 mm lower. This permits the pull tab label to be easily peelable from the pouch in the vicinity of the notch and of higher peel strength in the vicinity of the opening or perforated openable area in the pouch. The surface area of the pull tab label covered by the varnish may range from 10 to 50%, or 20 to 40%, or 25 to 35% of the total surface area of the pull tab label contacting the pouch. The surface area of the pull tab label covered by the varnish is made by pattern coating the pressure sensitive adhesive/substrate combination with the varnish to form the pull tab label as shown in FIG. 11 (*a*).

In an alternative form of the pull tab label, the surface area of the pull tab label (the one surface of the label that contacts the outer wall of the pouch) proximate the notch in the label is void of pressure sensitive adhesive so to keep the pull tab label from adhering to the pouch in this area. This allows for a region in the label where the pull tab may be easily lifted from the pouch and the peeling of the pull tab label from the pouch to be initiated. In this alternative form, the pull tab label has pressure sensitive adhesive in the region covering the opening or perforated openable area of the pouch. The surface area of the pull tab label on one surface void of the pressure sensitive adhesive may range from 10 to 50%, or 20 to 40%, or 25 to 35% of the total surface area of the pull tab label contacting the pouch. The surface area of the pull tab label void of the pressure sensitive adhesive is made by pattern coating with pressure sensitive adhesive the substrate that forms the pull tab label.

A polyester release liner may be applied to the varnish/adhesive surface or the adhesive surface of the pull tab label so that pull tab label may be formed into a roll and allow for ease of unrolling when cut to size and applied to a pouch. The release liner is removed from the pull tab label prior to the pull tab label being applied over the perforated or punched area in the panel or wall of a pouch.

The pull tab label is preferably rectangular in shape with its length ranging from 20 to 100 mm, or 30 to 80 mm, or 40 to 60 mm, and its width ranging from 5 to 50 mm, or 10 to 40 mm, or 15 to 25 mm. In one preferred form, the pull tab label is 50 mm long by 20 mm wide. The pull tab label shape may be alternatively square, oval, diamond, or round.

Alternatively, the substrate of the pull tab label may be an extrusion or adhesive lamination of two more materials. Non-limiting exemplary materials for a two or more layer lamination include polypropylene, polyethylene, polybutene, polyester, aluminum foil, biopolymers, polyamide, polyvinylchloride, metallized oriented polypropylene, metallized oriented polyester, metallized oriented polyamide, and copolymers and terpolymers of polypropylene, polyethylene, and polybutene. The adhesives described above for adhering layers of the pouch together may also be used for adhering two or more substrates of the pull tab label together to form a lamination.

FIG. 11 (*a*) is a cross section of a pull tab label indicating the layers (single layer form) included therein and FIG. 11 (*b*) is a front view of the pull tab label indicating its preferred dimensions. The substrate is 50 micron white polypropylene with a pressure sensitive adhesive and a pattern applied varnish over the adhesive. The outer surface of the polypropylene substrate is surface printed with a layer of an overprint varnish used to protect the ink. FIG. 11 (*b*) also indicates the area in the pull tab label ("v" or notch area) where the user initiates the pulling of the label for peeling it away from the pouch to create or expose an opening in the pouch. Also indicated in FIG. 11 (*b*) are three slits or cuts in the pull tab label above the apex of the upside down "v" which assist with the directional tearing of the label toward the right side of the label.

Figure 12:
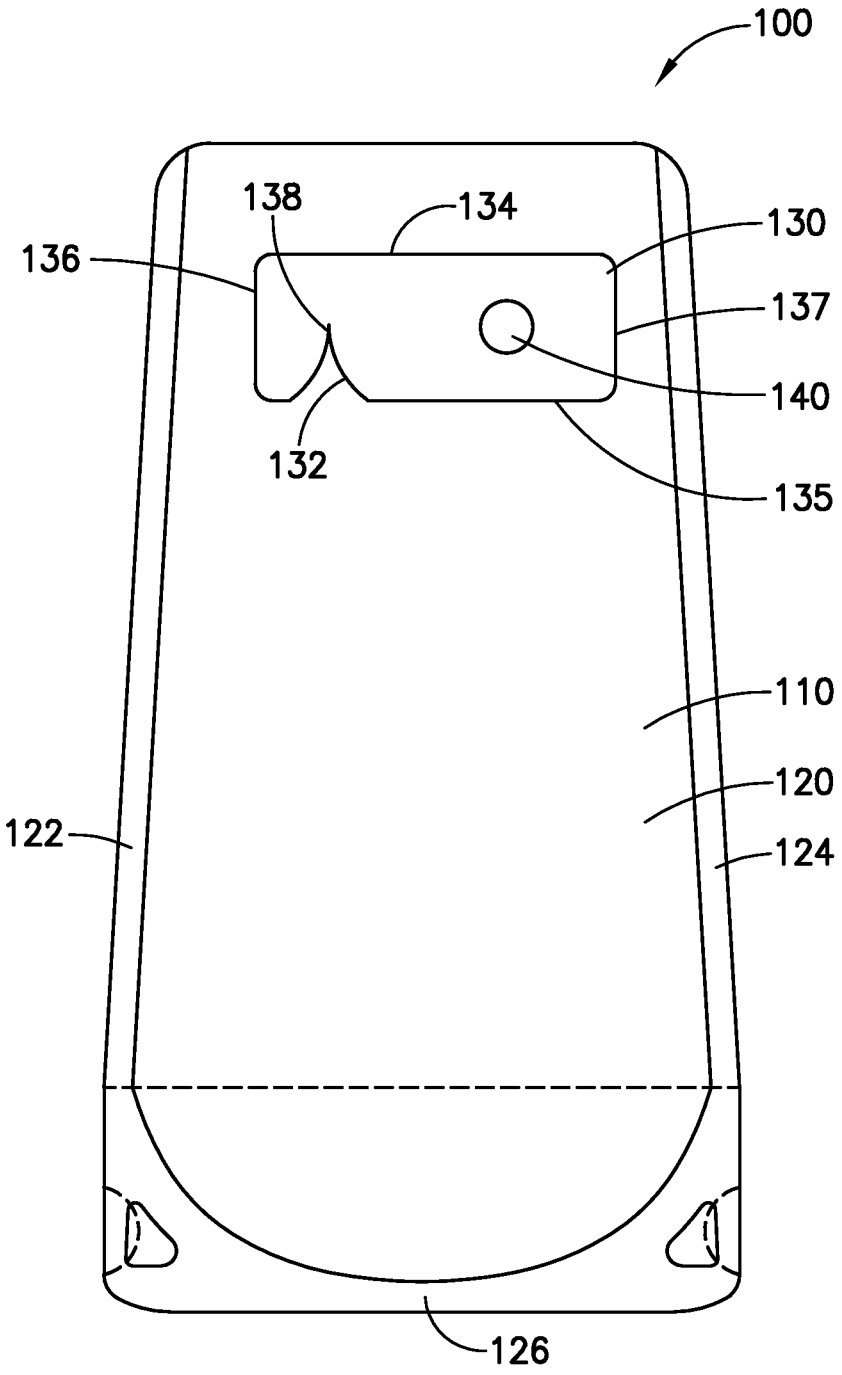
FIG. 12 is a front view of a pull tab and pouch combination according to one embodiment, wherein the pull tab is not formed as part of the pouch, but is a separate label (pull tab label embodiment)

FIG. 12 is a pull tab label pouch combination 100 including a flexible pouch 110 with a front wall 120 and a back wall (not shown). The pouch includes side edge seals 122, 124 and a bottom seal edge 126. The pull tab label 130 is positioned near the top of the front wall 120 of the pouch 110 and includes a "v" shaped notch 132 for initiating the peeling and tearing of the pull tab label 130 from the front wall 120 of the pouch 110. The pull tab label 130 is oriented such that its long edges 134,135 are parallel to the bottom seal edge 126 of the pouch 110. The short edges 136, 137 are approximately parallel to the side seal edges 122, 124 of the pouch 110. The "v" or tear notch 132 is oriented such that the "v" is upside down, which requires the user to pull upward to initiate the tear at the "v" apex 138 and peel the pull tab label 130 from the front face 120 of the pouch 110. The pull tab label 130 covers either an opening 140 in the pouch or a perforated openable area in the front wall 120 of the pouch 110. The opening 140 is preferably on the opposite side of the pull tab label 130 from that of the "v" or tear notch 132 as indicated in FIG. 12. The opening 140 in FIG. 12 is circular in shape.

Figure 13:
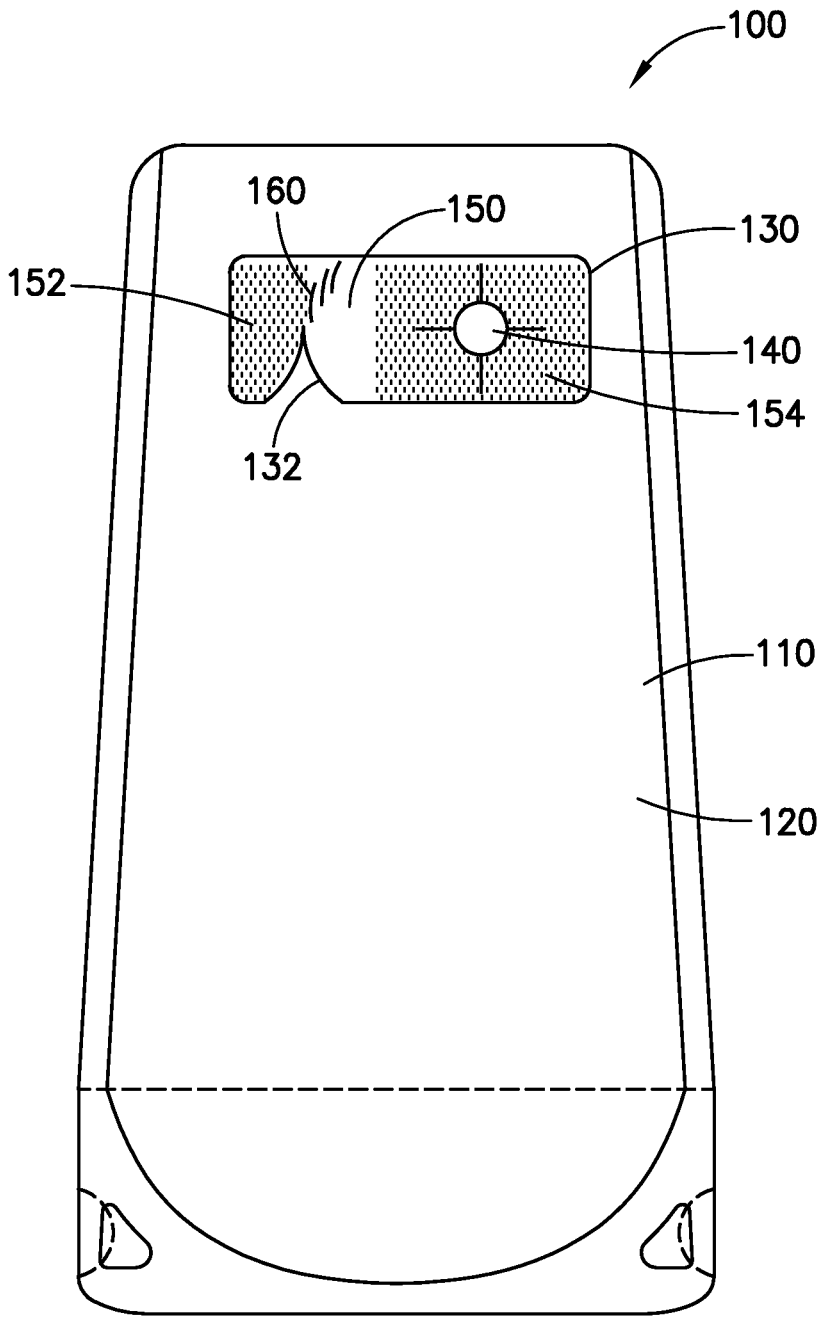
FIG. 13 is a front view according to FIG. 12 with area of the pull tab label that does and does not adhere to the pouch indicated and with tear directing curved slits or cuts above the notch.

FIG. 13 is a front view of an alternative form of the pull tab and pouch combination 100 according to FIG. 12 indicating the area of the pull tab label 130 that does not adhere to the front face 120 of the pouch. More specifically, the pull tab label 130 includes an area 150 adjacent to the front wall 120 of the pouch 110 and the "v" notch 132 that does not adhere or lightly adheres to the front wall 120 because of either no pressure sensitive adhesive or a layer of varnish over the pressure sensitive adhesive in this area. This area 150 of the pull tab label 130 adjacent to the front wall 120 of the pouch 110 that does not adhere or lightly adheres to the front wall 120 is indicated in FIG. 12 with no dots. In contrast, the remainder of the area 152, 154 of the pull tab label 130 includes a pressure sensitive adhesive that adheres to the front wall 120 of the pouch 110 and covers either an opening 140 in the pouch or a perforated openable area in the front wall 120 of the pouch 110. The remainder of the area 152, 154 of the pull tab label 130 adjacent to the front wall 120 of the pouch 110 that does adhere to the front wall 120 is indicated in FIG. 13 with dots. Also included in the pull tab label 130 of FIG. 13 are three curved slits or cuts 160. These curved slits or cuts 160 assist the pull tab label in peeling directionally toward the opening or perforated openable area 140 of the pouch 110. The curved slits or cuts 160 may pass through the entire thickness of the pull tab label 130 or a portion of the thickness. The curved slits or cuts 160 may be optionally straight and the number of cuts in close proximity to the notch may range from 1 to 6, or 2 to 5, or 3 to 4. Preferably the distance between adjacent slits or cuts 160 is the same, but may also not be equidistant.

The user initiates the removal of the pull tab label 130 from the pouch 110 at the "v" notch 132 by lifting and pulling on the pull tab label in the direction of the area 150 that does not adhere or lightly adheres to the front wall 120 of the pouch 110. This initiates the peeling of the pull tab label 130 from the front wall 120 and this continues into the curved slits or cuts 160 and then into the area 154 of the pull tab label 130, which includes pressure sensitive adhesive, which either exposes the opening 140 or removes the chad from the perforated openable area of the front wall 120 to create an opening 140. The area of the pull tab label 152 opposite the opening 140 in the pouch may remain adhered to the front wall 120 of the pouch.

Figure 14:
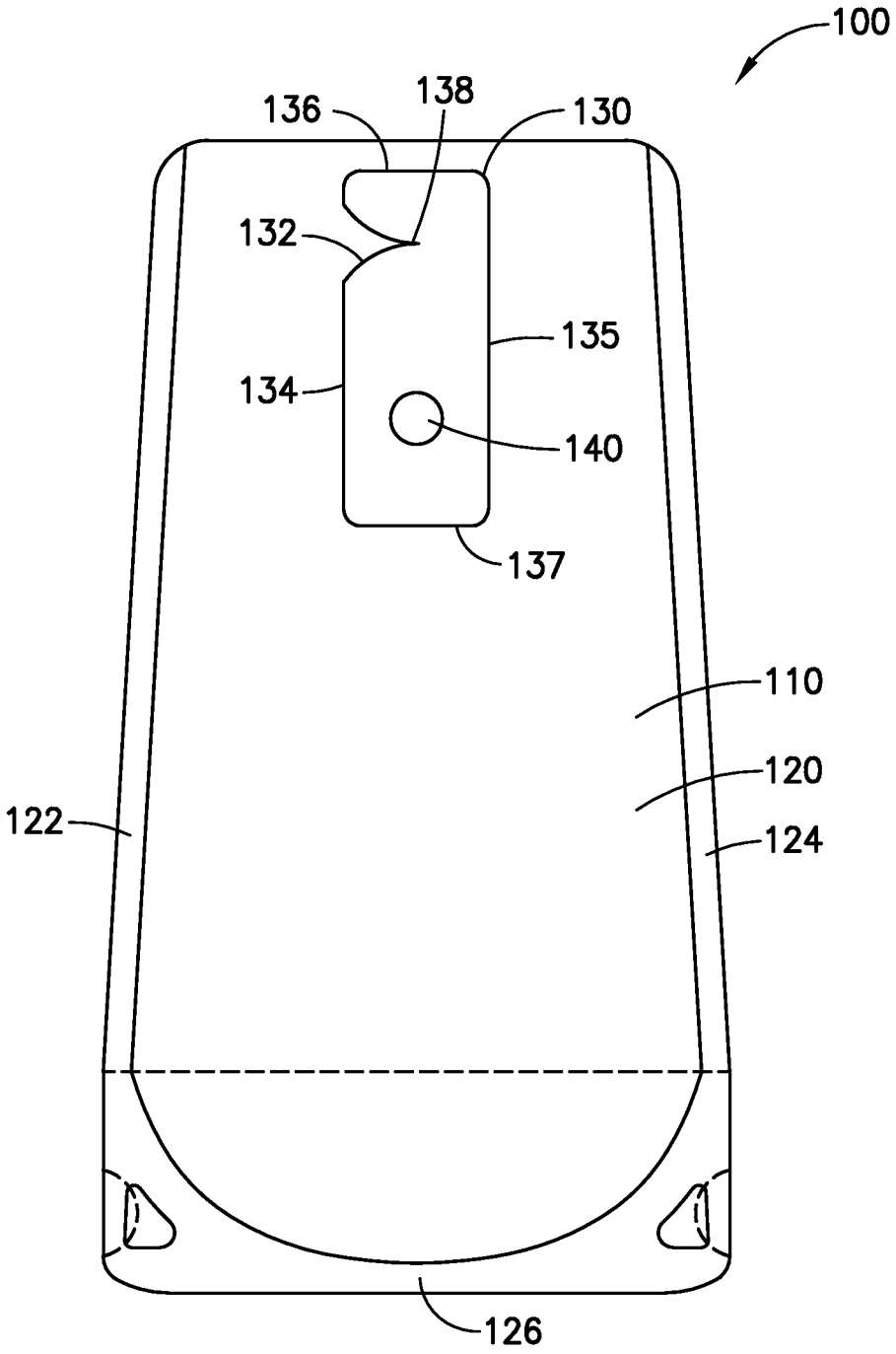
FIG. 14 is a front view according to FIG. 12 with the pull tab oriented in an alternative direction relative to the pouch.

FIG. 14 is a front view of the pull tab label pouch combination 100 according to FIG. 12 with the pull tab label 130 oriented in an alternative direction relative to the pouch 110. More specifically, the pull tab label 130 is oriented vertically (as opposed to horizontally in FIG. 12) relative to the front wall 120 of the pouch 110. In this form, the pull tab label 130 is oriented such that its long edges 134,135 are approximately parallel to the side seal edges 122, 124 of the pouch 110. The short edges 136, 137 are parallel to the bottom seal edge 126 of the pouch 110. The "v" or tear notch 132 is oriented such that the "v" is side ways, which requires the user to pull downward to initiate the tear at the "v" apex 138 and peel the pull tab label 130 from the front face 120 of the pouch 110.

Figure 15:
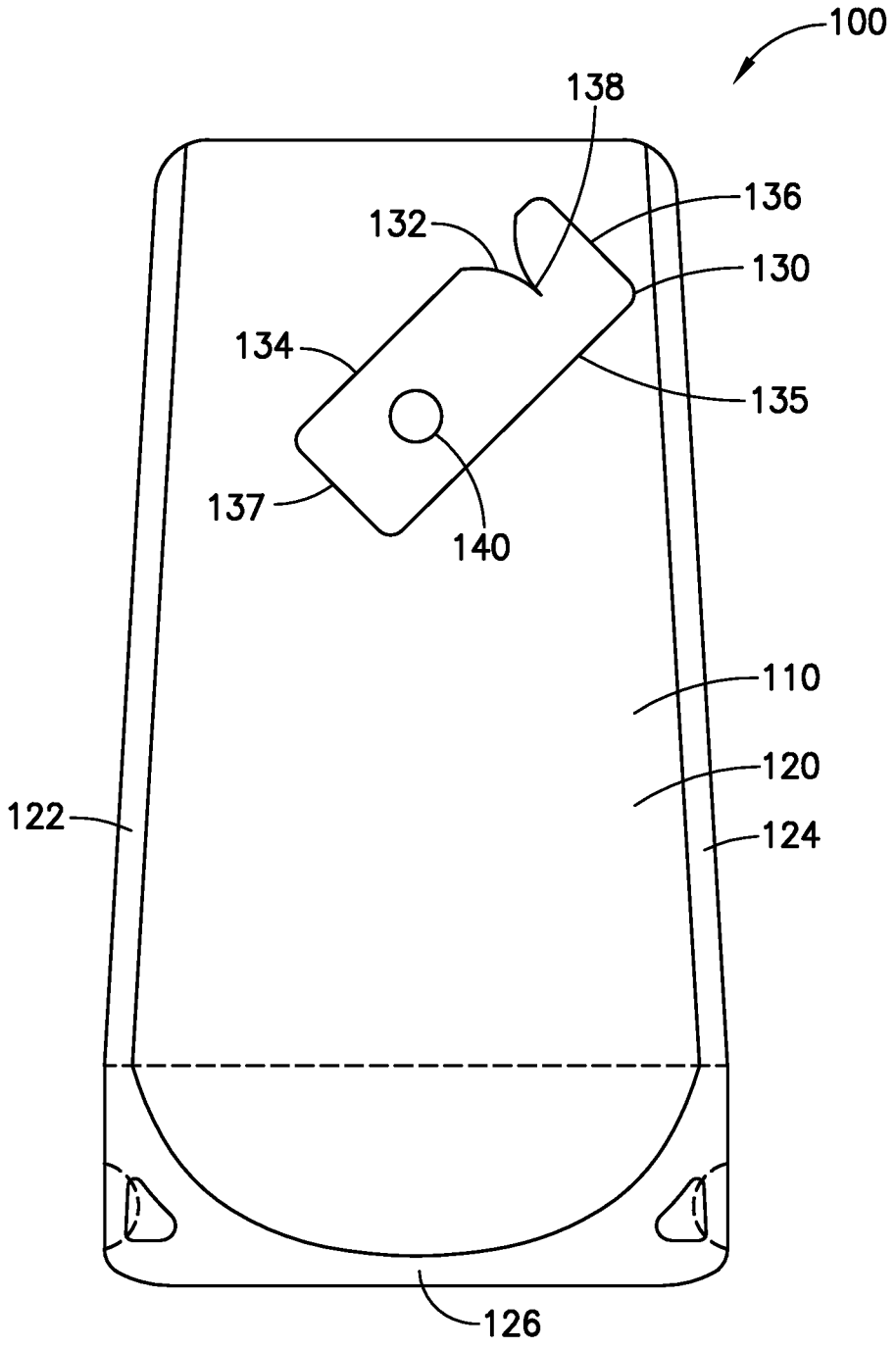
FIG. 15 is a front view according to FIG. 12 with the pull tab oriented in another alternative direction relative to the pouch.

FIG. 15 is a front view of the pull tab label pouch combination 100 according to FIG. 12 with the pull tab label 130 oriented in another alternative direction relative to the pouch 110. More specifically, the pull tab label 130 is oriented at approximately a 45 degree angle relative to the side seal edges 122, 124 of the pouch 110. In this form, the pull tab label 130 is oriented such that its long edges 134,135 are approximately 45 degrees relative to the side seal edges 122, 124 of the pouch 110. The short edges 136, 137 are also approximately 45 degrees relative to the bottom seal edge 126 of the pouch 110. The "v" or tear notch 132 is oriented such that the "v" is off-set from side seal edge direction of the pouch 110, which requires the user to pull downward at an angle to initiate the tear at the "v" apex 138 and peel the pull tab label 130 from the front face 120 of the pouch 110.

Optional Tear Off Feature

Both the integrated pull tab—pouch embodiment and the pull tab label—pouch embodiment of the instant invention may include a pouch with a top tear off feature. The optional tear off feature permits the top of the pouch to be torn off the remainder of the pouch and to create a large opening at the top of the pouch. This permits the user to gulp the liquid contents from the pouch. This is particularly suitable for viscous liquids such as yogurt, smoothies and frozen beverages. The top tear off feature is formed by putting a pair of notches in the side seal edges of the pouch near the top of the pouch. The notch allows the user to initiate the tearing of the top side seal of the pouch and continue the tearing across the top width of the pouch to the opposite side seal edge notch. This allows for the top of the pouch above the pair of notches to be completely or partially removed from the pouch to create a large hole for dispensing of the pouch contents. This may also be referred to as a gulp feature because liquid contents of the pouch may be rapidly gulped from the pouch due to the larger opening created at the top. The pair of notches in the side seal edges of the pouch may be formed by laser scoring or mechanically scoring the edge. The feature allows for the straw hole opening not to be used for removal of the pouch contents.

Figure 16:
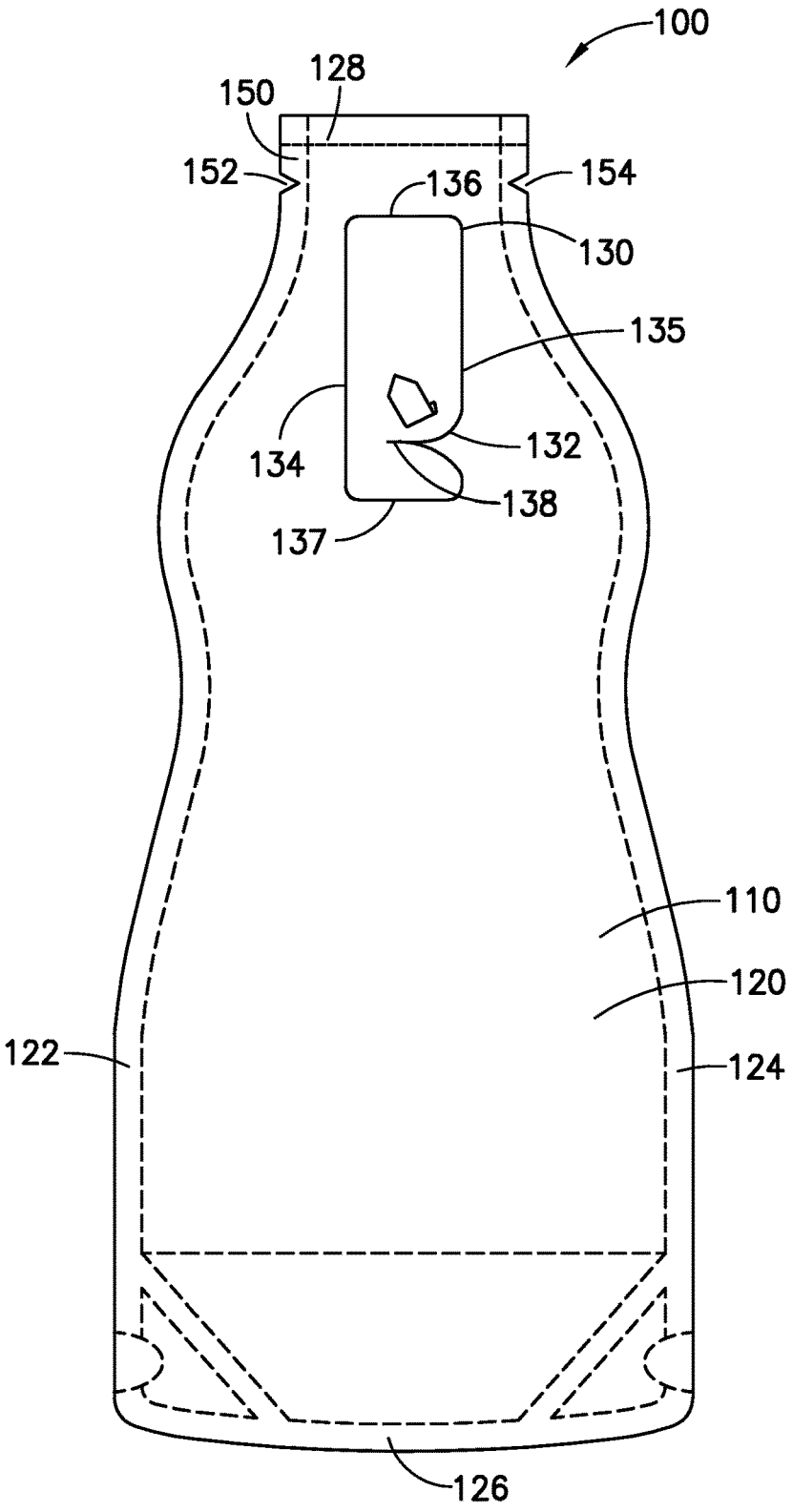
FIG. 16 is a front view of pull tab and pouch combination including the pull tab label embodiment oriented in yet another alternative direction relative to the pouch and the pouch also including the optional top tear off feature.

FIG. 16 is a front view of the pull tab label pouch combination 100 according to FIG. 12 with the pull tab label 130 oriented in yet another alternative direction relative to the pouch 110 and also including the top tear off feature 150. More specifically, the pull tab label 130 is oriented vertically (as opposed to horizontally in FIG. 12) relative to the front wall 120 of the pouch 110. In this form, the pull tab label 130 is oriented such that its long edges 134,135 are approximately parallel to the side seal edges 122, 124 of the pouch 110. The short edges 136, 137 are parallel to the bottom seal edge 126 of the pouch 110. The "v" or tear notch 132 is oriented such that the "v" is side ways, which requires the user to pull upward (as opposed to downwards in FIG. 14) to initiate the tear at the "v" apex 138 and peel the pull tab label 130 from the front face 120 of the pouch 110. The top tear off feature 150 includes a notch 152, 154 in each of the side seal edges 122, 124 near the top seal edge 128 of the pouch. The top tear off feature 150 allows the user to tear the top seal edge 128 off the top of the pouch 110 by tearing the pouch from one notch 152 to the other notch 154. This creates a large opening (not shown) to permit the user to drink or gulp the contents of the pouch.

Figure 17:
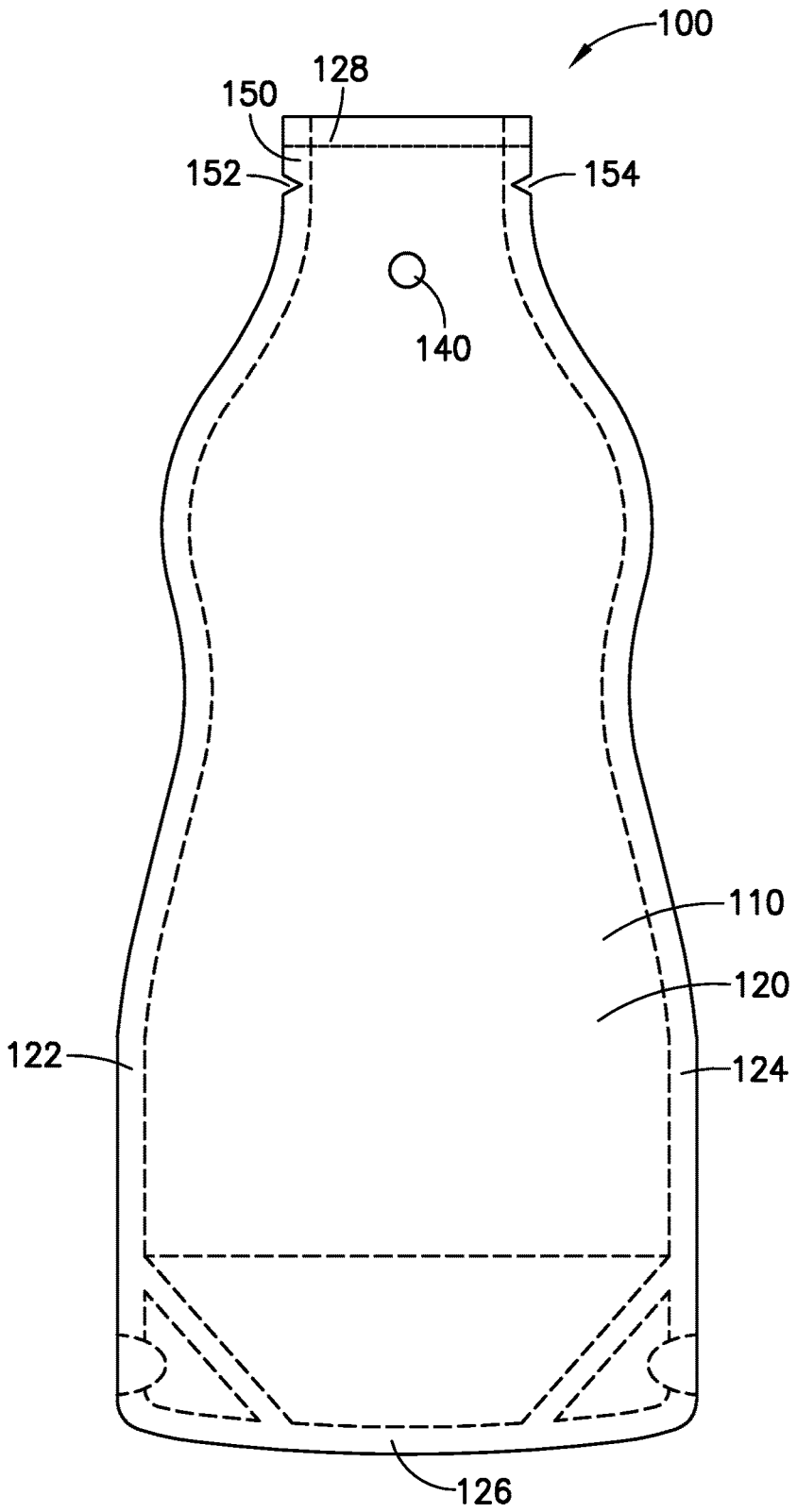
FIG. 17 is a front view of the pouch according to FIG. 16 put prior to the attachment of the pull tab label.

FIG. 17 is a front view of the pull tab label pouch combination 100 pouch according to FIG. 16 put prior to the attachment of the pull tab label. The top tear off feature 150 includes a notch 152, 154 in each of the side seal edges 122, 124 near the top seal edge 128 of the pouch.

Method of Making for Integrated Pull Tab—Pouch Embodiment

The invention also involves a process for creating a packaging container according to one of the previous designs, which is characterized by a front wall material web, a closure film web and a back wall material web that are oriented in a transport direction so that they are at least partially parallel to each other, with the front wall material running between a cutting tool; the front wall material web is then led by a back plate between the closure film web and the back wall material web and separated, with the cutting tool creating the cutline, and the closure film web then lining up with the front material web to be connected, which results in the creation of the connection area.

The statement, "at least partially parallel" should be understood in the present disclosure in such a way that slight deviations in the material webs, such as might happen in the area of the back plate, are minimized. The term "connection tools" should be understood to mean both sealing or stamping tools as well as glue application tools.

This process is especially advantageous in that the individual webs are already basically parallel, before adding the cutline, so that it is unnecessary to resort to special measures to position the webs opposite each other in the transport direction.

Although the design examples described below as packaging container 1 are for drinks, the invention is not limited to drink containers. On the contrary, packaging containers based on this invention can also be used for pasty products such as soap or in the grocery sector, for example, for fruit purees or yogurt drinks. Such packaging containers are also suitable for dry, very grainy or powdery products, not only in the grocery sector, but also, for example, in the chemical, cosmetics or completely general technology sectors.

Figure 1:
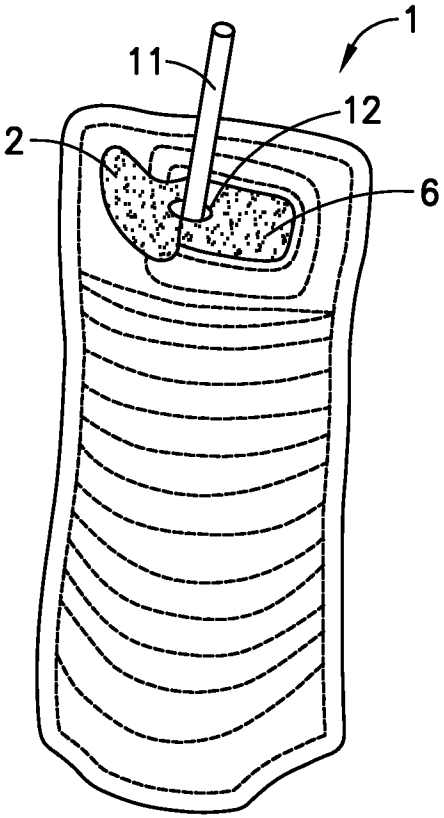
FIG. 1 A perspective view of a packaging container with a straw inside.

FIG. 1 shows a drink container 1, which in this example is shown as a standing container. In the upper area of the drink container 1 a raised pull tab 2 is visible, showing a view of a closure film 6 in the area of the pull tab 2 matched up inside the container or packaging material. In the closure film, there is an opened opening 12 visible, in which a straw 11 is inserted.

Figure 10:
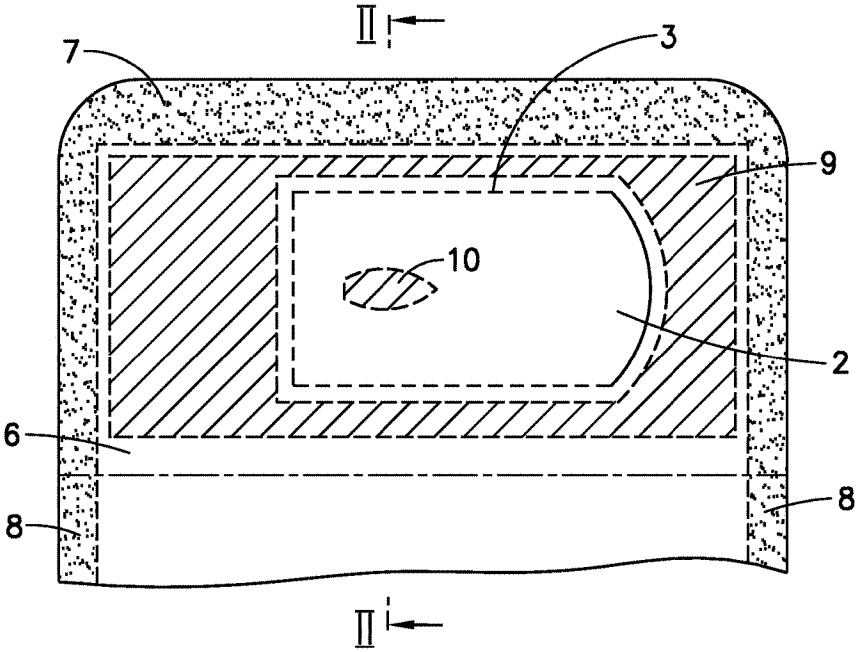

FIG. 2 shows the upper area of the same drink container 1 in a view along a cut vertical line. Based on FIG. 3 described below, FIG. 2 shows a cut along Line II-II. The drink container 1 includes of a front wall 4, a back wall 5 and a bottom surface, which, however is not visible in this figure. In the front wall 4, the pull tab 2 that is created from the front wall material 4 by a cutline 3 is depicted, which in this view is not yet raised, but is flush with the front wall 4. Inside the front wall 4 there is a closure film 6 attached by sealing, for example. A connection zone, in which the closure film is connected to the front wall, is depicted with the indicator 9. A connection area, in which the pull tab 2 is connected to the closure film 6, which is described below in more detail, in connection with FIGS. 3 and 10, depicted with the indicator 10.

Figure 3:
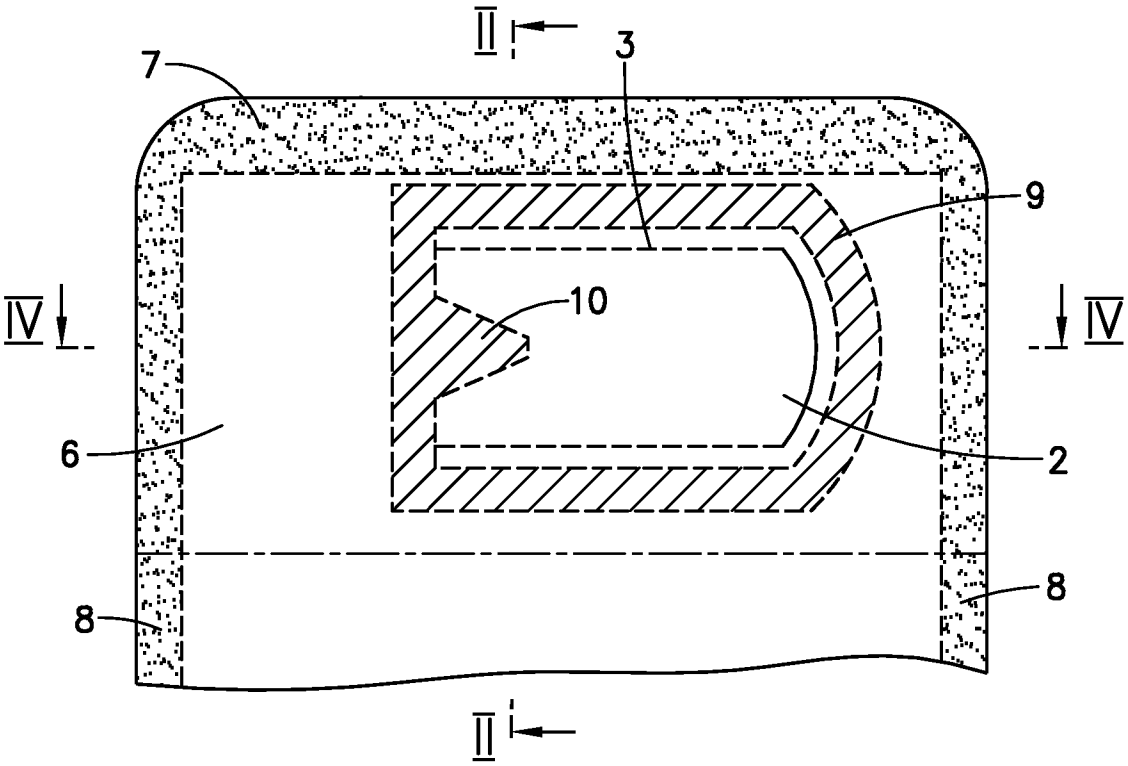
FIG. 3 an enlarged section of the pull tab area indicated in the packaging container, FIGS. 4 to 7 each with a horizontal cut along Line IV-IV in FIG. 3, in front, during and after opening, as well as with a straw inside, FIG. 8 in a top view, a schematic depiction of production steps for packaging containers, FIG. 9 in a side view, a schematic depiction of production steps for packaging containers, FIG. 10 a view according to FIG. 3 with a different design, FIG. 11 (*a*) is cross section of an exemplary pull tab label embodiment indicating the layers included therein, and FIG. 11 (*b*) is a front view of the pull tab label.
Figure 5:
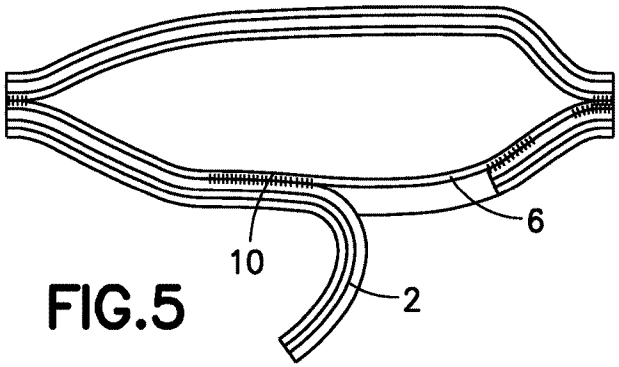
Figure 7:
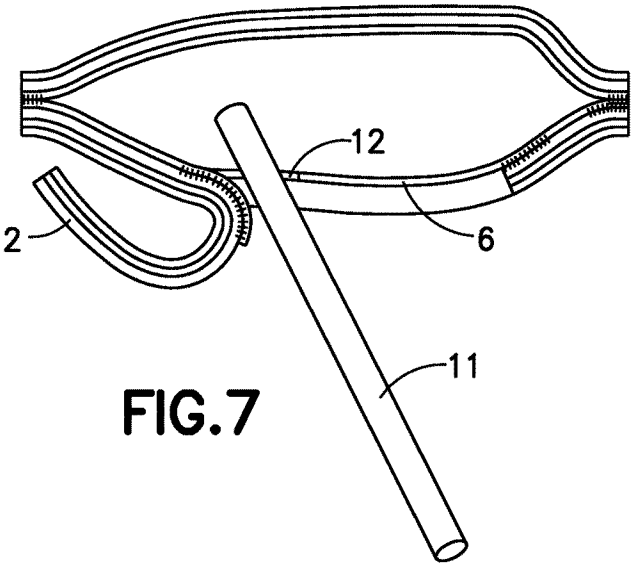
Figure 4:
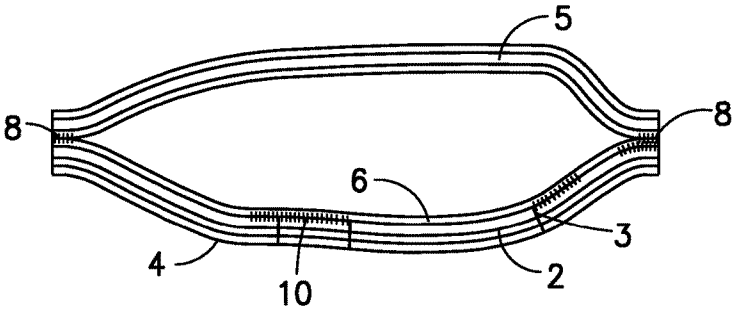
Figure 6:
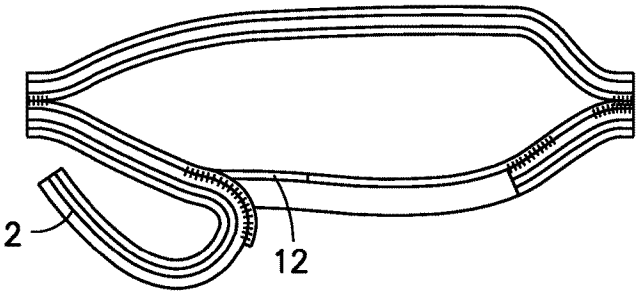

FIG. 3 shows a top view of the upper area of the drink container 1 from FIG. 1 before opening and on an enlarged scale in comparison to FIG. 1. It is very easy to see here that the pull tab 2 is depicted with a cutline 3, which in the depicted example has the form of a reclining "U." The cutline 3 can 10 be completely continuous or, as depicted, broken, in the form of a perforated line. A combination could also be considered, in which the cutline 3 is continuous on one side and perforated on the other side. The closure film 6 is depicted as a band in the example, which just barely covers the area of the pull tab 2 on the inside of the drink container. The closure film 6 could, however, also cover the entire inner side of the front wall 4 of the drink container 1. In addition, in FIG. 3 one can see a top edge sealing seam 7 and two side edge sealing seams 8. In the area of the pull tab 2, for example purposes, the connection zone 9 is depicted, in which the closure film 6 is connected and sealed to the front wall 4 on both of their inner sides. In the above-mentioned connection 10 the closure film 4 is connected to the pull tab 2 by sealing, for example. This connection area 10 reaches from a base of the pull tab 2, which also stays connected after pulling with the packaging material of the front wall 4 in the direction of the free end of the pull tab 2, whereby it is tapered. In this tapered part of the connection area 10, upon pulling on the pull tab 2, pressure spikes appear in the closure film 6, so that it begins to rip in this area and with this, the opening 12 is created. When the straw 11 is pushed in, it would be best if the front wall 4 and the back wall 5 were spaced apart from each other in the area of the opening 12. This can be done very easily by holding the drink container 1 by the raised pull tab 2, while with the other hand, the straw 11 is inserted into the opening 12. Since most people are right-handed and, therefore, are predisposed to put the straw 11 in with their right hand, the cutline 3 is advantageously placed so that the pull tab 2 can be pulled from right to left, and the container can be opened and held with the left hand, while the right hand holds the straw and inserts it into the container. Often, with such drink containers, the straw 11 is attached to the outside of the drink container in processing. In this case, it would be best if the straw 11 were removed from the drink container 1 before the pull tab 2 is pulled. This kind of approach can be easily and reliably predetermined by placing the straw 11 over the cutline 3 created by the pull tab 2 during processing of the drink container 1. In FIGS. 4 to 7, each of the cut views along the Line IV-IV in FIG. 3 shows the opening process of the drink container 1, as depicted step by step. FIG. 4 shows the drink container in a closed state, whereby on the right the cutline 3 is indicated and on the left the pull tab 2 is connected to it. In the inside of the drink container the closure film 6 is depicted from edge to edge continuously. The connection area 10, in which the closure film 6 is connected to the pull tab 2, is also indicated in this figure. In the depiction in FIG. 5, the pull tab 2 is raised, but the closure film 6 is not yet ripped. FIG. 6 shows a situation in which in connection area 10 the closure film 6 is ripped and creates the opening 12. Finally, FIG. 7 shows the drink container 5 with a straw 11 inside the opening 12.

As mentioned, the pull tab 2 protects the closure film 6 from dirt, especially where the opening 12 is located. This protection can be even more optically improved by attaching or sealing an additional projecting sealing film on the outside, over the area of the pull tab 2 in such a way that the cutline 3 is completely covered by the sealing film. This additional sealing film is not depicted in the drawings.

Figure 8:
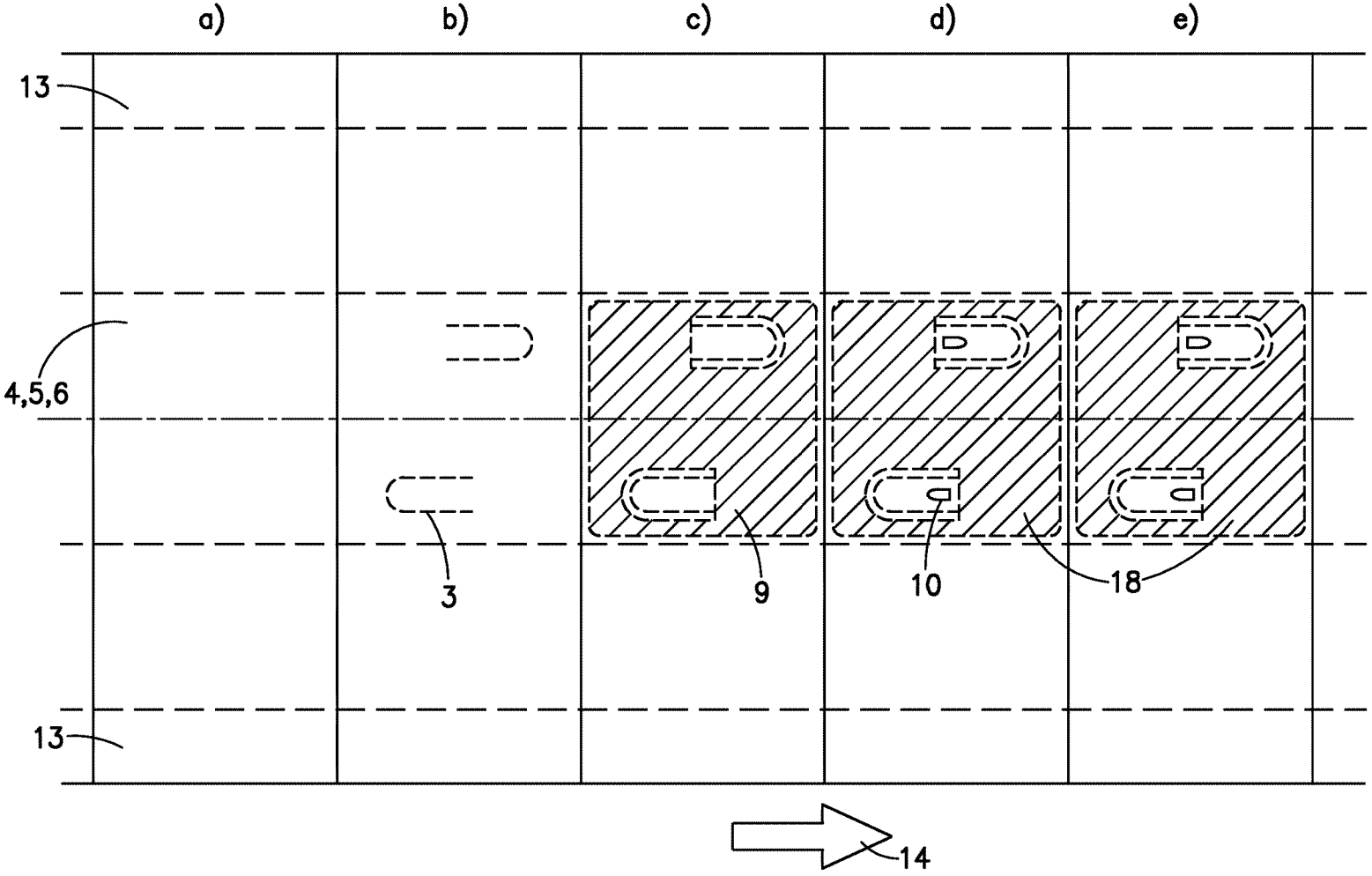
Figure 9:
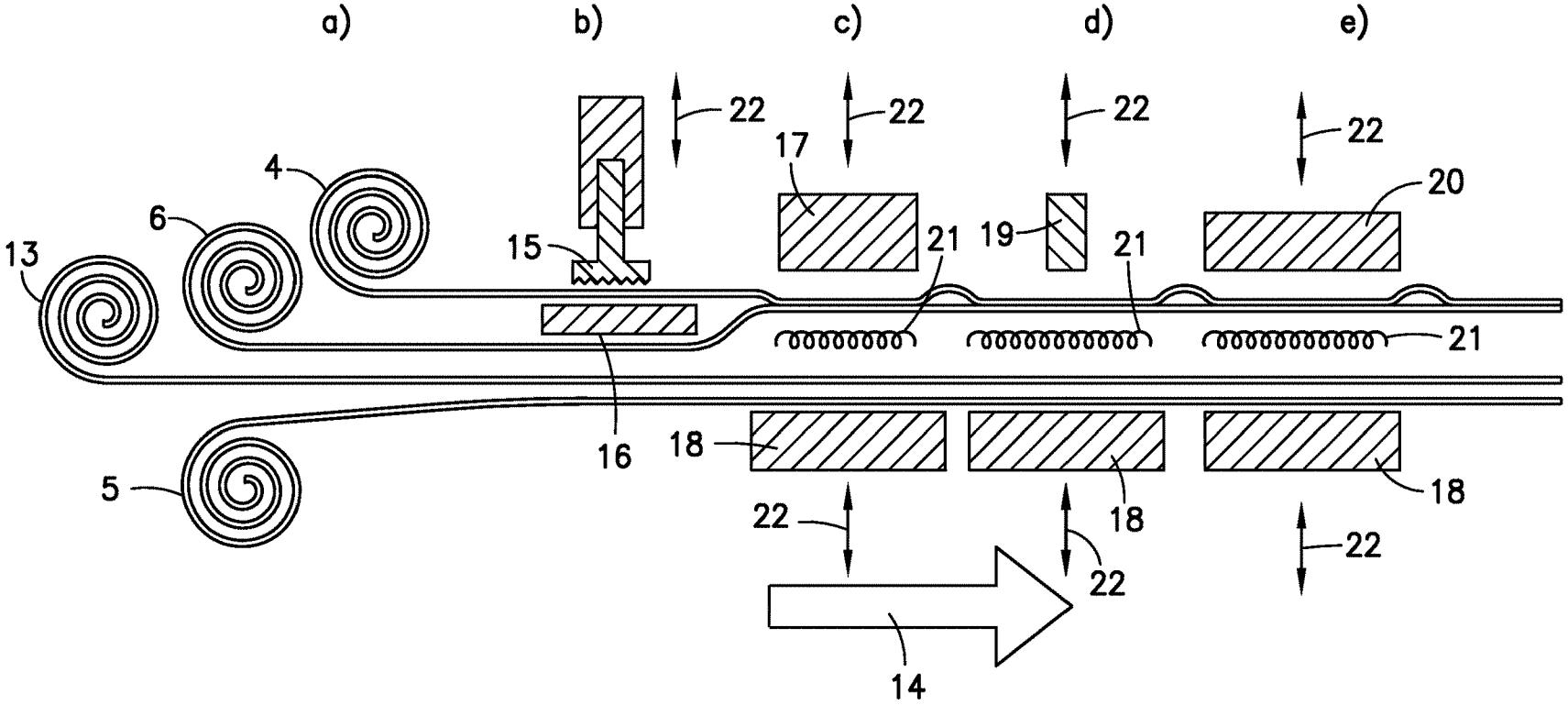

In FIGS. 8 and 9, an example of a production process is schematically depicted for the drink container 1, as per the invention, whereby with the letters a) to e), the sections of a production facility are depicted, in which the material webs are transported, step by step, in a direction depicted by arrow 14. FIG. 8 shows a top view of the material webs, while in FIG. 9 a schematic side view is depicted. As FIG. 8 shows, in the depicted design example, the material webs are set up so that two drink containers are set up next to each other in such a way that their top areas are lined up next to each other and the bottom areas lie on the edges of the material webs. In section a), material webs, specifically a web to be created later for the front wall 4 of the drink container 1, the web to be created for the back wall 5, the web to be created for the closure film 6, and two webs to be created later for the bottom film 14 are all unwrapped from supply rolls and are transported, step by step, at least somewhat parallel to each other.

In section b), as shown by the double arrow 22, movable cutting tools 15 are brought to the cutlines 3 to be used later for creating the front wall 4 material web. As indicated in the drawings in FIG. 9, the jagged edges of the cutting tools 15 show that the material between the cuts still holds together, in order to create perforated cutlines 3.

In order for the material webs that lie under there not to be damaged by the cutting tool 15, a back plate 16 is aligned between the material web 4 and the other material web.

In section c) there is a first mobile sealing tool 17 aligned, shown by the double arrow 22, with the closure film 6 in the connection zone 9, so that the front wall 4 can be connected. In order for no undesirable sealing between the other webs will occur in this area c), a separating film can be set up, and as is depicted with indicator 17 located on the opposite side, a cooling plate 18 is aligned, so that the heat from the material webs will be directed away.

In section d) is a second mobile sealing tool 19, which is aligned, as shown by the double arrow 22, with the closure film 6 in the connection area 10, which is connected to the pull tab 2. Also here, there can be a separation film set up between the material webs to prevent undesired sealing. Also opposite this second sealing tool 19 a cooling plate 18 can be set up. The work process of section c) and section d), described here for example purposes, is not mandatory. It can also be sealed first in the connection area 10 and then in the connection zone 9.

In section e), there is a cooling plate 18, as shown in the figure below, aligned with an upper cooling plate 20, to remove extra heat issuing from the sealing operation from the material webs.

Especially sections in which thermal operations are carried out can be sequentially set up in double or more alignment, in order to increase the capacity of the production facilities. After section e), additional sections follow, in which edge seals can be added and finally the finish drink container 1 can be separated, either from the material webs, or else the material webs can be rolled up again, in order to add a filling facility for the drink container in this form. These known process steps for the production of flexible bottles are not essential to the invention and therefore are not described or depicted in more detail here.

FIG. 10 shows a depiction according to FIG. 3 of another design example. As described above, the cutline 3 is open, as an example according to FIG. 3, so that in the base area of the pull tab 2, it remains connected after pulling it from the packaging material. This has the advantage that the pull tab 2 does not have to be removed separately, but involves the risk that the drink container 1 will be damaged, if the pull tab 2 is pulled too forcefully. In order to eliminate this danger and, in addition, to fulfill the desire of some providers, who, for example, print collectable point images on their containers, pull tabs 2 are provided that are suitable for collection points to be printed with the pull tab as shown in FIG. 10 created by a closed, continuous cutline 3. In contrast to the example according to FIG. 3, in the example according to FIG. 10, the connection area 10 to create the opening 12 in the closure film 6 is not connected to the connection zone 9, in which the closure film 6 is connected to the inside of the front wall. Rather, the connection area 10, which is depicted like an island, according to FIG. 10, and preferably designed with a taper in the direction of the free end of the pull tab 2. If the connection area 10 as shown is narrow, the opening 12 will also be narrow upon ripping, so that after inserting the straw 11, the opening 12 is practically sealed, so that no liquid can escape from the container 1 around the drinking straw.

In accordance with one or more aspects of the disclosed embodiments a packaging container (1) comprising a minimum of one layer of a shaped packaging material including a pull tab (2) to make an opening (12) in the packaging container, wherein the pull tab (2) includes a cutline (3) formed in the packaging material and further including a closure film (6) attached, at least in the area of the pull tab (2) on the inside of the shaped packaging material, and with the pull tab (2) connected in a connection area (10) to the closure film (6), wherein by pulling on the pull tab (2) in the connection area (10), the opening (12) in the packaging container (12) is created. In accordance with one or more aspects of the disclosed embodiments the packaging container (1) wherein the connection area (10) is tapered in the direction of the free end of the pull tab (2). In accordance with one or more aspects of the disclosed embodiments wherein the cutline (3) includes two free ends and is in the shape of a "U." In accordance with one or more aspects of the disclosed embodiments the packaging container (1), wherein the closure film (6) includes connecting zones (9) of the pull tab (2) connected to the packaging material and that the connection area (10) at one end of the pull tab (2) is aligned and connected to the connecting zones (9). In accordance with one or more aspects of the disclosed embodiments the packaging container (1), wherein the cutline (3) has no free end and Borders a closed bottle (2). In accordance with one or more aspects of the disclosed embodiments the packaging container (1), wherein the closure film (6) is connected on one end of one of the connecting zones (9) around the pull tab (2) to the packaging material and that the connection area (10) is aligned at a distance from the connecting zones (9). In accordance with one or more aspects of the disclosed embodiments the packaging container (1), wherein the cutline (3) includes perforations along at least one part of its length. In accordance with one or more aspects of the disclosed embodiments the packaging container (1), wherein the cutline (3) along at least one part of its length is continuous. In accordance with one or more aspects of the disclosed embodiments the packaging container (1), wherein the pull tab (2) on the outside of the packaging material is covered with a projecting sealing film over the cutline (3). In accordance with one or more aspects of the disclosed embodiments a method for making a packaging container comprising: providing a front wall material web (4), a closure film web (6) and a back wall material web (5), transporting the front wall material web (4), the closure film web (6) and the back wall material web (5) in a transport direction (14), at least closely parallel to each other, so that the front wall material web (4) is led between a cutting tool (15) from the closure film web (6) and the back wall material web (5) from the separating back plate (16), so that a cutline (3) will by created by the cutting tool (15) and that the cutting tool (15) will be aligned with the connection tools (17, 19) by the transport direction (14) so that the closure film web (6) will be connected with the front material web (4) and the connection area (10) will be created to form a packaging container.

Applicants have attempted to disclose all embodiments and applications of the disclosed subject matter that could be reasonably foreseen. However, there may be unforeseeable, insubstantial modifications that remain as equivalents. While the present invention has been described in conjunction with specific, exemplary embodiments thereof, it is evident that many alterations, modifications, and variations will be apparent to those skilled in the art in light of the foregoing description without departing from the spirit or scope of the present disclosure. Accordingly, the present disclosure is intended to embrace all such alterations, modifications, and variations of the above detailed description.

All patents, test procedures, and other documents cited herein, including priority documents, are fully incorporated by reference to the extent such disclosure is not inconsistent with this invention and for all jurisdictions in which such incorporation is permitted.

When numerical lower limits and numerical upper limits are listed herein, ranges from any lower limit to any upper limit are contemplated.

In accordance with one or more aspects of the disclosed embodiment a packaging container comprising a pouch with at least one opening in a pouch wall or at least one perforated openable area in a pouch wall for dispensing contents of the pouch, and one or more pull tab labels adhesively connected to at least one outside wall of the pouch and covering the at least one opening or one perforated openable area, wherein the one or more pull tab labels comprise a substrate with at least one notch in at least one edge of the one or more pull tab labels and a pressure sensitive adhesive on at least a portion of one surface of the substrate, wherein the peel strength between one or more pull tab labels and the at least one outside wall of the pouch is lower in the area of the pull tab label proximate the notch then in the area of the pull tab label proximate the at least one opening or one perforated openable area in the pouch.

In accordance with one or more aspects of the disclosed embodiment the pressure sensitive adhesive completely covers one surface of the substrate and a varnish covers the pressure sensitive adhesive area in the surface area of the pull tab label proximate the notch of the pull tab label.

In accordance with one or more aspects of the disclosed embodiment the pressure sensitive adhesive partially covers one surface of the substrate, and wherein the surface area of the pull tab label proximate the notch is void of pressure sensitive adhesive.

In accordance with one or more aspects of the disclosed embodiment further including one or more cuts or slits in the pull tab label proximate the notch and passing through the thickness of the label.

In accordance with one or more aspects of the disclosed embodiment the notch is "v" shaped.

In accordance with one or more aspects of the disclosed embodiment the one or more pull tab labels are of a shape selected from the group consisting of rectangular, circular, square, oval, and diamond.

In accordance with one or more aspects of the disclosed embodiment the shape is rectangular.

In accordance with one or more aspects of the disclosed embodiment the rectangular shaped pull tab label ranges in length from 20 to 100 mm and in width from 5 to 50 mm.

In accordance with one or more aspects of the disclosed embodiment the notch is in a long edge of the rectangular shape.

In accordance with one or more aspects of the disclosed embodiment the pull tab label is oriented with its long edges parallel to the bottom end seal of the pouch.

In accordance with one or more aspects of the disclosed embodiment the notch is located in the long edge of the pouch closer to the bottom end seal of the pouch.

In accordance with one or more aspects of the disclosed embodiment the notch is located in the long edge of the pouch further from the bottom end seal of the pouch.

In accordance with one or more aspects of the disclosed embodiment the pull tab label is oriented with its short edges parallel to the bottom end seal of the pouch.

In accordance with one or more aspects of the disclosed embodiment the at least one opening or one perforated openable area in the pouch is of a shape selected from the group consisting of rectangular, circular, square, oval, and diamond.

In accordance with one or more aspects of the disclosed embodiment the at least one opening or one perforated openable area in the pouch is circular.

In accordance with one or more aspects of the disclosed embodiment the at least one circular opening or circular perforated openable area ranges in diameter from 4 to 20 mm.

In accordance with one or more aspects of the disclosed embodiment the at least one circular perforated openable area includes two half-circle shaped cuts with two unperforated areas interconnecting the two half-circle shaped cuts.

In accordance with one or more aspects of the disclosed embodiment the two unperforated areas connecting the two half-circle shaped cuts are offset from 180 degrees of one another or vertical by a range of from 1 to 15 degrees.

In accordance with one or more aspects of the disclosed embodiment the two unperforated areas connecting the two half-circle shaped cuts range in width from 0.1 to 1.0 mm.

In accordance with one or more aspects of the disclosed embodiment the substrate is selected from the group consisting of paper, aluminum foil, biopolymers, polypropylene, polyethylene, polybutene, polyester, polyamide, polyvinylchloride, and copolymers and terpolymers of polypropylene, polyethylene, and polybutene.

In accordance with one or more aspects of the disclosed embodiment the substrate is vacuum metallized with aluminum on at least one surface.

In accordance with one or more aspects of the disclosed embodiment the substrate is polypropylene.

In accordance with one or more aspects of the disclosed embodiment the thickness of the substrate ranges from 10 to 100 microns.

In accordance with one or more aspects of the disclosed embodiment the substrate is an extrusion or adhesive lamination of two or more materials selected from the group consisting of paper, aluminum foil, biopolymers, polypropylene, polyethylene, polybutene, polyester, polyamide, polyvinylchloride, and copolymers and terpolymers of polypropylene, polyethylene, and polybutene.

In accordance with one or more aspects of the disclosed embodiment the at least one of the two or more materials are vacuum metallized with aluminum on at least one surface.

In accordance with one or more aspects of the disclosed embodiment the pressure sensitive adhesive is selected from the group consisting of an acrylic, a urethane, butyl rubber, ethylene-vinyl acetate, natural rubber, nitriles, silicone rubbers, styrene block copolymers, styrene-butadiene-styrene, styrene-ethylene/butylene-styrene, styrene-ethylene/propylene and styrene-isoprene-styrene and vinyl ether.

In accordance with one or more aspects of the disclosed embodiment the pressure sensitive adhesive is an acrylic hot melt.

In accordance with one or more aspects of the disclosed embodiment the coating weight of the pressure sensitive adhesive ranges from 5 to 30 g/m$^2$.

In accordance with one or more aspects of the disclosed embodiment the peel strength of pressure sensitive adhesive (measured from steel after 20 minutes at about 23° C. and 50% air humidity) ranges from 2 to 12 N/20 mm.

In accordance with one or more aspects of the disclosed embodiment the varnish is an acrylic or a urethane.

In accordance with one or more aspects of the disclosed embodiment the coating weight of the varnish ranges from 5 to 30 g/m$^2$.

In accordance with one or more aspects of the disclosed embodiment the peel strength of the varnish (measured from steel after 20 minutes at about 23° C. and 50% air humidity) ranges from 1 to 5 N/20 mm.

In accordance with one or more aspects of the disclosed embodiment the peel strength of the varnish is from 2 to 10 N/20 mm lower than the peel strength of the pressure sensitive adhesive.

In accordance with one or more aspects of the disclosed embodiment the surface area of the pull tab label covered by the varnish is from 10 to 50% of the total surface area of the pull tab label contacting the pouch.

In accordance with one or more aspects of the disclosed embodiment the surface area of the pull tab label void of the pressure sensitive adhesive is from 10 to 50% of the total surface area of the pull tab label contacting the pouch.

In accordance with one or more aspects of the disclosed embodiment the pouch is a two or three layer adhesive or extrusion lamination of materials selected from the group consisting of polyester, polyamide, aluminum foil, metallized oriented polypropylene, metallized oriented polyester, metallized oriented polyamide, polypropylene, polyethylene, ethylene vinyl alcohol, biopolymers, and copolymers and terpolymers of ethylene, propylene and butene-1.

In accordance with one or more aspects of the disclosed embodiment the pouch is a three layer adhesive lamination of polyester, aluminum foil and polyethylene.

In accordance with one or more aspects of the disclosed embodiment further including a top tear off feature in the pouch comprising a pair of notches in the side seal edges of the pouch and proximate the top of the pouch.

In accordance with one or more aspects of the disclosed embodiment including one opening in the pouch.

In accordance with one or more aspects of the disclosed embodiment including one perforated openable area in the pouch.

In accordance with one or more aspects of the disclosed embodiment the perforated openable area includes a chad on the inside periphery of the openable area.

In accordance with one or more aspects of the disclosed embodiment the chad adheres to the pull tab label when the pull tab label is peeled from the outside wall of the pouch to create an opening in the outside wall of the pouch.

In accordance with one or more aspects of the disclosed embodiment a method of making a packaging container comprising providing a pouch with at least one opening in a pouch wall or at least one perforated openable area in a pouch wall for dispensing contents of the pouch, and one or more pull tab labels, adhering the one or more pull tab labels to at least one outside wall of the pouch, and covering the at least one opening or one perforated openable area in the pouch wall with the one or more pull tab labels, the one or more pull tab labels comprise a substrate with at least one notch in at least one edge of the one or more pull tab labels and a pressure sensitive adhesive on at least a portion of one surface of the substrate, wherein the peel strength between one or more pull tab labels and the at least one outside wall of the pouch is lower in the area of the pull tab label proximate the notch then in the area of the pull tab label proximate the at least one opening or one perforated openable area in the pouch.

In accordance with one or more aspects of the disclosed embodiment forming one or more cuts or slits in the pull tab label proximate the notch and passing through the thickness of the label.

In accordance with one or more aspects of the disclosed embodiment the notch is "v" shaped.

In accordance with one or more aspects of the disclosed embodiment forming a pair of notches in the side seal edges of the pouch and proximate the top of the pouch to provide a top tear off feature.

In accordance with one or more aspects of the disclosed embodiment an opening in a packaging container for dispensing of the container contents comprising providing a pouch with at least one opening in a pouch wall or at least one perforated openable area in a pouch wall for dispensing contents of the pouch, and one or more pull tab labels adhesively secured to at least one outside wall of the pouch, and covering the at least one opening or one perforated openable area in the pouch wall, the one or more pull tab labels comprise a substrate with at least one notch in at least one edge of the one or more pull tab labels and a pressure sensitive adhesive on at least a portion of one surface of the substrate, wherein the peel strength between one or more pull tab labels and the at least one outside wall of the pouch is lower in the area of the pull tab label proximate the notch then in the area of the pull tab label proximate the at least one opening or one perforated openable area in the pouch, the perforated openable area includes a chad on the inside periphery of the openable area, and pulling the one or more pull tab labels at the notch to initiate the peeling of the one or more pull tab labels from the outside wall of the pouch, and peeling the one or more pull tab labels from the outside wall of the pouch such to expose the at least one opening in the pouch wall or to remove the chad from the at least one perforated openable area to create at least one opening in the pouch wall, wherein the chad adheres to the pressure sensitive adhesive of the pull tab label when the pull tab label is peeled from the outside wall of the pouch.

In accordance with one or more aspects of the disclosed embodiment an opening in a packaging container of claim 47, wherein the pouch further includes a top tear off feature in the pouch comprising a pair of notches in the side seal edges of the pouch and proximate the top of the pouch.

In accordance with one or more aspects of the disclosed embodiment inserting a straw into the at least one opening for dispensing the container contents.

In accordance with one or more aspects of the disclosed embodiment tearing the top tear off feature from the top of the pouch to create an opening for dispensing the container contents.

In accordance with one or more aspects of the disclosed embodiment the one or more pull tab labels further include one or more cuts or slits in the pull tab label proximate the notch and passing through the thickness of the label.

In accordance with one or more aspects of the disclosed embodiment the notch is "v" shaped.

In accordance with one or more aspects of the disclosed embodiment the at least one opening or one perforated openable area in the pouch is circular.

In accordance with one or more aspects of the disclosed embodiment the at least one circular opening or perforated openable area ranges in diameter from 4 to 20 mm.

In accordance with one or more aspects of the disclosed embodiment the at least one circular perforated openable area includes two half-circle shaped cuts with two unperforated areas connecting the two half-circle shaped cuts.

In accordance with one or more aspects of the disclosed embodiment the two unperforated areas connecting the two half-circle shaped cuts are offset from 180 degrees of one another or vertical by a range of from 1 to 15 degrees.

In accordance with one or more aspects of the disclosed embodiment the two unperforated areas connecting the two half-circle shaped cuts range in width from 0.1 to 1.0 mm.

It should be understood that the foregoing description is only illustrative of the aspects of the disclosed embodiment. Various alternatives and modifications can be devised by those skilled in the art without departing from the aspects of the disclosed embodiment. Accordingly, the aspects of the disclosed embodiment are intended to embrace all such alternatives, modifications and variances that fall within the scope of the appended claims. Further, the mere fact that different features are recited in mutually different dependent or independent claims does not indicate that a combination of these features cannot be advantageously used, such a combination remaining within the scope of the aspects of the invention.

What is claimed is:

1. A packaging container comprising a pouch with at least one perforated openable area in a pouch wall for dispensing contents of the pouch, and one or more rectangular shaped pull tab labels adhesively connected to at least one outside wall of the pouch and covering the at least one perforated openable area, wherein the one or more rectangular shaped pull tab labels comprise a substrate with at least one v-shaped notch in at least one edge of the one or more rectangular shaped pull tab labels and a pressure sensitive adhesive on at least a portion of one surface of the substrate, wherein the peel strength between the one or more rectangular shaped pull tab labels and the at least one outside wall of the pouch is lower in an area of the pull tab label proximate the notch than in an area of the pull tab label proximate the at least one perforated openable area in the pouch, wherein the at least one perforated openable area in the pouch is circular, wherein the at least one circular perforated openable area includes two half-circle shaped cuts with two unperforated areas interconnecting the two half-circle shaped cuts, wherein the width of the two unperforated areas is about 0.6 mm, and wherein the two unperforated areas connecting the two half-circle shaped cuts are offset from vertical by about 7 degrees, wherein the one or more rectangular shaped pull tab labels are oriented with their long edges parallel to a bottom end seal of the pouch and the v-shaped notch is in a long edge of the rectangular shape, and wherein the v-shaped notch is located on the left hand side of the long edge closer to the bottom end seal of the pouch of the pull tab label.

2. The packaging container of claim 1, wherein the pressure sensitive adhesive completely covers the one surface of the substrate and a varnish covers the pressure sensitive adhesive area in the area of the pull tab label proximate the notch of the pull tab label.

3. The packaging container of claim 2, wherein the varnish is an acrylic or a urethane.

4. The packaging container of claim 2, wherein the coating weight of the varnish ranges from 5 to 30 g/m$^2$.

5. The packaging container of claim 2, wherein the peel strength of the varnish (measured from steel after 20 minutes at about 23° C. and 50% air humidity) ranges from 1 to 5 N/20 mm.

6. The packaging container of claim 2, wherein the peel strength of the varnish is from 2 to 10 N/20 mm lower than the peel strength of the pressure sensitive adhesive.

7. The packaging container of claim 2, wherein the area of the pull tab label covered by the varnish is from 10 to 50% of a total surface area of the pull tab label contacting the pouch.

8. The packaging container of claim 1, wherein the pressure sensitive adhesive partially the covers one surface the substrate, and wherein the area of the pull tab label proximate the notch is void of pressure sensitive adhesive.

9. The packaging container of claim 8, wherein the area of the pull tab label void of the pressure sensitive adhesive is from 10 to 50% of a total surface area of the pull tab label contacting the pouch.

10. The packaging container of claim 1, further including one or more cuts or slits in the pull tab label proximate the notch and passing through the thickness of the pull tab label.

11. The packaging container of claim 1, wherein the rectangular shaped pull tab label ranges in length from 20 to 100 mm and in width from 5 to 50 mm.

12. The packaging container of claim 1, wherein the at least one circular perforated owe able area ranges in diameter from 4 to 20 mm.

13. The packaging container of claim 1, wherein the substrate is selected from the group consisting of paper, aluminum foil, biopolymers, polypropylene, polyethylene, polybutene, polyester, polyamide, polyvinylchloride, and copolymers and terpolymers of polypropylene, polyethylene, and polybutene.

14. The packaging container claim 13, wherein the substrate is vacuum metallized with aluminum on at least one surface.

15. The packaging container of claim 13, wherein the substrate is polypropylene.

16. The packaging container claim 13, wherein the thickness of the substrate ranges from 10 to 100 microns.

17. The packaging container of claim 1, wherein the substrate is an extrusion or adhesive lamination of two or more materials selected from the group consisting of paper, aluminum foil, biopolymers, polypropylene, polyethylene, polybutene, polyester, polyamide, polyvinylchloride, and copolymers and terpolymers of polypropylene, polyethylene, and polybutene.

18. The packaging container of claim 17, wherein the at least one of the two or more materials are vacuum metallized with aluminum on at least one surface.

19. The packaging container of claim 1, wherein the pressure sensitive adhesive is selected from the group consisting of an acrylic a urethane, butyl rubber, ethylene-vinyl acetate, natural rubber, nitriles, silicone rubbers, styrene block copolymers, styrene-butadiene-styrene, styrene-ethylene/butylene-styrene, styrene-ethylene/propylene and styrene-isoprene-styrene and vinyl ether.

20. The packaging container of claim 19, wherein the pressure sensitive adhesive is an acrylic hot melt.

21. The packaging container of claim 1, wherein the coating weight of the pressure sensitive adhesive ranges from 5 to 30 g/m$^2$.

22. The packaging container of claim 1, wherein the peel strength of pressure sensitive adhesive (measured from steel after 20 minutes at about 23° C. and 50% air humidity) ranges from 2 to 12 N/20 mm.

23. The packaging container of claim 1, wherein the pouch is a two or three layer adhesive or extrusion lamination of materials selected from the group consisting of polyester, polyamide, aluminum foil, metallized oriented polypropylene, metallized oriented polyester, metallized oriented polyamide, polypropylene, polyethylene, ethylene vinyl alcohol, biopolymers, and copolymers and terpolymers of ethylene, propylene and butene-1.

24. The packaging container of claim 23, wherein the pouch is a three layer adhesive lamination of polyester, aluminum foil and polyethylene.

25. The packaging container of claim 1, further including a top tear off feature in the pouch comprising a pair of notches in side seal edges of the pouch and proximate a top of the pouch.

26. The packaging container of claim 1, wherein the at least one perforated openable area includes one perforated openable area in the pouch.

27. The packaging container of claim 26, wherein the perforated openable area includes a chad on the inside periphery of the openable area.

28. The packaging container of claim 27, wherein the chad adheres to the pull tab label when the pull tab label is peeled from the outside wall of the pouch to create an opening in the outside wall of the pouch.

29. A method of making a packaging container comprising:

providing a pouch with at least one perforated openable area in a pouch wall for dispensing contents of the pouch, and one or more pull rectangular shaped tab labels, adhering the one or more rectangular shaped pull tab labels to at least one outside wall of the pouch, and covering the at least one perforated openable area in the pouch wall with the one or more rectangular shaped pull tab labels, wherein the one or more rectangular shaped pull tab labels comprise a substrate with at least one v-shaped notch in at least one edge of the one or more rectangular shaped pull tab labels and a pressure sensitive adhesive on at least a portion of one surface of the substrate, wherein the peel strength between the one or more rectangular shaped pull tab labels and the at least one outside wall of the pouch is lower an area of the pull tab label proximate the notch than in an area of the pull tab label proximate the at least one perforated openable area in the pouch, wherein the at least one perforated openable area in the pouch is circular, wherein the at least one circular perforated openable area includes two half-circle shaped cuts with two unperforated areas interconnecting the two half-circle shaped cuts, wherein the width of the two unperforated areas is about 0.6 mm, and wherein the two unperforated areas connecting the two half-circle shaped cuts are offset from vertical by about 7 degrees, wherein the one or more rectangular shaped pull tab labels are oriented with their long edges parallel to a bottom end seal of the pouch and the v-shaped notch is in a long edge of the rectangular shape, and wherein the v-shaped notch is located on the left hand side of the long edge closer to the bottom end seal of the pouch of the pull tab label.

30. The method of claim 29, further comprising forming one or more cuts or slits in the pull tab label proximate the notch and passing through the thickness of the label.

31. The method of making of claim 29 further comprising forming a pair of notches in side seal edges of the pouch and proximate a top of the pouch to provide a top tear off feature.

32. A method of making an opening in a packaging container for dispensing of the container contents comprising:

providing a pouch with at least one perforated openable area in a pouch wall for dispensing contents of the pouch, and one or more rectangular shaped pull tab labels adhesively secured to at least one outside wall of the pouch, and covering the at least one perforated openable area in the pouch wall, wherein the one or more rectangular shaped pull tab labels comprise a substrate with at least one v-shaped notch in at least one edge of the one or more rectangular shaped pull tab labels and a pressure sensitive adhesive on at least a portion of one surface of the substrate, wherein the peel strength between the one or more rectangular shaped pull tab labels and the at least one outside wall of the pouch is lower in an area of the pull tab label proximate the notch than in an area of the pull tab label proximate the at least one perforated openable area in the pouch, wherein the perforated openable area includes a chad on an inside periphery of the perforated openable area, and pulling the one or more rectangular shaped pull tab labels at the notch to initiate the peeling of the one or more rectangular shaped pull tab labels from the outside wall of the pouch, and peeling the one or more rectangular shaped pull tab labels from the outside wall of the pouch such to remove the chad from the at least one perforated openable area to create at least one opening in the pouch wall, wherein the child adheres to the pressure sensitive adhesive of the pull tab label when the pull tab label is peeled from the outside wall of the pouch, wherein the at least one perforated openable area in the pouch is circular, wherein the at least one circular perforated openable area includes two half-circle shaped cuts with two unperforated areas interconnecting the two half-circle shaped cuts, wherein the width of the two unperforated areas is about 0.6 mm, and wherein the two unperforated areas connecting the two half-circle shaped cuts are offset from vertical by about 7 degrees, wherein the one or more rectangular shaped pull tab labels are oriented with their long edges parallel to a bottom end seal of the pouch and the v-shaped notch is in a long edge of the rectangular shape, and wherein the v-shaped notch is located on the left hand side of the long edge closer to the bottom end seal of the pouch of the pull tab label.

33. The method of making an opening in a packaging container of claim 32, wherein the pouch further includes a top tear off feature in the pouch comprising a pair of notches in side seal edges of the pouch and proximate a top of the pouch.

34. The method of making an opening in a packaging container of claim 33 further comprising tearing the top tear off feature from the top of the pouch to create an opening for dispensing the container contents.

35. The method of making an opening a packaging container of claim 32 further comprising inserting a straw into the at least one opening for dispensing the container contents.

36. The method of making an opening in a packaging container of claim 32, wherein the one or more rectangular shaped pull tab labels further include one or more cuts or slits in the gull tab label proximate the notch and passing through the thickness of the label.

37. The method of making an opening in a packaging container of claim 32, wherein the at least one perforated openable area ranges in diameter from 4 to 20 mm.

* * * * *